US005420481A

United States Patent [19]

McCanney

[11] Patent Number: 5,420,481

[45] Date of Patent: May 30, 1995

[54] FLUORESCENT LAMP WITH WIDE RANGE OF LUMINOUS INTENSITIES

[75] Inventor: Neil R. McCanney, Tampa, Fla.

[73] Assignee: Smiths Industries, Florham Park, N.J.

[21] Appl. No.: 127,012

[22] Filed: Sep. 27, 1993

[51] Int. Cl.[6] ..... G05F 1/00

[52] U.S. Cl. ..... 315/291; 315/330; 315/335; 315/340; 315/351; 315/354; 315/DIG. 1; 315/DIG. 4

[58] Field of Search ..... 315/291, 335, 330, DIG. 1, 315/DIG. 4, 351, 354, 340

[56] References Cited

U.S. PATENT DOCUMENTS 2,864,035 12/1958 Davis ..... 315/335
3,890,540 6/1975 Ott ..... 315/335
5,030,894 7/1991 Yoshiike et al. ..... 315/335

*Primary Examiner*—Robert J. Pascal
*Assistant Examiner*—Reginald A. Ratliff
*Attorney, Agent, or Firm*—Gerald E. Hespos; Anthony J. Casella

[57] ABSTRACT

An apparatus is provided for controlling the luminous output of a fluorescent lamp over a wide dimming range. The luminous output is controlled by controlling the lamp current, while the lamp is immersed in a lateral electrostatic field. The lamp and external electrostatic ionization electrodes are driven by a true analog voltage-to-current converter that has a dynamic range inherently wider than conventional PWM circuits. A modified, transformer coupled, push-pull converter with an analog-current-driven primary circuit is used in one embodiment of the apparatus. The lamp driver must be capable of providing a high compliance voltage consistent with the I–V profile of the lamp. A subordinate primary winding on the transformer may be used to reduce magnetization current and to supply sufficient energy for supporting the lateral electrostatic field that is generated by the ionization electrodes which may be printed on a PWB mounted behind the lamp.

23 Claims, 13 Drawing Sheets

FLUORESCENT LAMP WITH WIDE RANGE OF LUMINOUS INTENSITIES

BACKGROUND OF THE INVENTION

1. Field of the Invention

The present invention relates to a system and method for controlling the luminous output of gas discharge lamps over a very broad dynamic range and more particularly to a fluorescent lamp dimmer arrangement which varies the light intensity over a range from less than 1 ftL to over 10,000 ftL.

2. Problem to be Solved

At present, commercially-available dimmers for fluorescent lamps operate over a range of approximately 150:1 or only 46 dB. However, it is necessary and desirable to control the luminous output of fluorescent tubes over a very broad dynamic range in special applications, such as the backlighting of an LCD display in a military airborne environment where a range from approximately 10,000 ftL to about 1 ftL (80 dB) is required. Some lamp dimmer circuits developed in the aerospace industry have improved the commercial performance with dimming ratios approaching 2000:1 or 66 dB. Achieving operation and control of lamp luminosity over a still greater and required range of 10,000:1 or more is not straightforward due to the nature of the fluorescence phenomenon.

In order to understand how to control the luminous output of a fluorescent lamp, it is necessary to fully understand how they operate, their basic limitation, and most importantly the nature of their electrical characteristics that determine the "load" that the fluorescent lamp will present to the lamp driving circuits.

THE FLUORESCENT LAMP

A fluorescent lamp consists of a glass envelope or tube that typically contains a Penning gas of argon and mercury at a low, fixed pressure of between 3 and 30 torr. Each end of the glass envelope is fitted with an internal electrode, which may or may not be externally heated by a filament current source. There are a variety of known cathodic electrode structures and means for preheating, starting and maintaining operation in various lamp types.

Basic operations of all configurations is as follows. Firstly, free electrons are released into the envelope space between the cathodic electrodes, either by thermionic heating (using an externally provided filament current), field emission (using high electrode potentials) or a combination of both. At a specific ionization potential some of the gas molecules will become ionized, conduction will begin and a net charge will be transported through the gas medium between the electrodes at each end of the tube. This creates an ion population and a directed charge motion within an electric field. This gaseous conduction causes the mercury vapor ions to become energetic enough to radiate photons in the ultraviolet spectrum. UV radiation, the photons of which have wave lengths too short to be seen, impact a phosphor coating on the internal surface of the tube. The energy transferred in the absorption by the phosphor will partially be re-radiated at a longer wave length in the visible spectrum providing a luminous output. The process of absorbing energy at short wave lengths and re-radiating it at a longer wave length is called fluorescence (phosphorescence). In effect, the ion population controls the luminous intensity of the lamp since the phosphor luminous output level is a function of the energy imparted to it, via the ionization transfers of the mercury vapor. There is a relationship between the ionization levels, ionization rates, and the gaseous conduction of the tube that support the current flow. Ion population density and current flow are related. The higher the current flow, the brighter the lamp; the lower the current, the dimmer the lamp. Although not necessarily purely linear, there is a relationship over a very wide range. Consequently, a key operating principle of fluorescent lamps is that control of current through the gaseous medium controls the luminous intensity. However, controlling the current is not a simple matter.

ELECTRICAL CONDUCTION IN GASES

All fluorescent tubes are GAS GLOW DISCHARGE DEVICES. A study of the physics of glow or arc discharges in gaseous medium and of gas glowing discharge devices demonstrates that there are many complex and competing processes that produce and remove charges, which alter the ion population and the electric fields that direct them. The control of the current through a conductive, ionized gas is possible, but it is a complex process. The electrical conduction in gases and gas filled tubes encompasses a variety of effects and modes of conduction, ranging from the Townsend discharge at one extreme to the arc discharge at the other. The current ranges from a fraction of 1 microampere in Townsend discharge, to thousands of amperes in the arc discharge. A feature which distinguishes gaseous conduction from conduction in a solid is the active part which the medium plays in the process. Not only does the gas permit the drift of free charges from one electrode to the other, but the gas itself may be ionized to produce other charges which can interact with the electrodes to liberate additional charges. It will be shown below that the current voltage characteristic may be nonlinear and multivalued.

GASEOUS CONDUCTION

To produce gaseous conduction, there must be a source of free charges, and there must be an electric field to produce a directed motion of these charges.

The free charge concentration is a result of a number of processes which produce and remove charges.

SOURCES OF FREE CHARGE

Many gaseous devices contain a thermionic-emission cathode which produces electron emission when heated. Also, as noted above, another source of electrons is field emission. Here, a strong positive field at a metallic surface lowers the barrier for electron emission. Thus, the electron current from a surface at a given temperature may be significantly increased. Both of these effects result in electron production.

In most of these methods of charge production, the sources are primary in origin and the presence of other free charges is not important in the production of ionization or electrons. Other processes are secondary in origin, although they may be of prime importance. As noted, photons can originate either externally or as a secondary effect. Field emission can be a secondary effect also. However, other methods of ionization, are considered to be secondary in origin. Ionization of gas by electron impact is such a case. Here free electrons may gain enough energy in an electric field to interact with an atomic or molecular electron to produce an ion pair.

Cumulative ionization is an extension of ionization by impact. If the original electron and its offspring gain sufficient energy so that each produces another electron, and if this process repeatedly continues, the result is called an avalanche, and the ionization produced is referred to as cumulative ionization.

A secondary source is an electron emission from either the electron or positive ion bombardment of a surface. This should not be confused with thermionic emission resulting from the heating of a surface that is under ionic bombardment. Sources which may be important are atomic collisions, sputtering and collisions of the second kind. In the first case, an atom or heavy ion may collide with an atom to produce ionization. This is quite unlikely until an energy many times the ionization energy is obtained. The second is somewhat analogous to secondary electron emission. Here the positive ions strike a surface and free atoms or groups of atoms, some of which come off as ions. In the third case, an excited atom may interact with an atom or molecule which is chemically different and has an ionization potential lower than the excitation potential of the excited atom. This interaction occurs between the argon and mercury in a Penning gas mixture. The result may be the decay of the excited state with ionization of the struck molecule or atom. Symbolically, this is shown by the following reaction, where A* is the excited atom, B the struck atom or molecule, and $e^-$ an electron.

$$A^*+B=A+B^++e^-$$

NET FREE-CHARGE CONCENTRATION

The net free-charge concentration is a balance between charge-production and charge-removal processes. Recombination is one such process. Here, an electron or heavy negative ion and a positive ion may recombine. The energy transition may appear as electromagnetic radiation or may be carried off by a third body, if one is present. There are a wide variety of conditions which lead to recombination. When the temperature and electric field are high, recombination will occur predominantly at the walls of the containing tube.

The method of charge removal is important from the aspect of conduction. If the charges move to the appropriate electrodes under the influence of the field and there recombine, then they contribute to the current. If they simply diffuse to the walls and recombine there with ions of the opposite sign, or if they recombine in the gas volume, they may not appear as part of the external current.

MOTION OF THE CHARGES

The motion of the charges within the gas will be largely influenced by the potential function. For regular geometries, this could be calculated in principle if there were no charges present. However, in a gas with free charges distributed throughout, the problem is quite different. The charges modify the charge-free potential, but the potential determines how the charge will move. The motion of the charges further modifies the potential and so on. Although the situation can be described physically by Poisson's equation, it is impractical to conduct an analysis. As a practical result, the potential function must be determined by measurements which are made with probes. This requires careful procedures to obtain significant results.

ION DIFFUSION

Ion diffusion is a type of random motion which is always present and is the result of thermal or agitation energy. The randomness of the motion results from the many collisions with molecules and other ions. A great difference exists in the motions of electrons and heavy ions. Because of low mass, electrons are easily deflected and move erratically. They diffuse badly, and only approximately follow field lines. Again, because the mass is small, an electron can give up appreciable energy only in an inelastic collision, in which excitation or ionization takes place. Hence, electron agitation and diffusion will be much greater in a pure inert gas than in a gas that has many low-energy molecular states. Conversely, heavy ions exchange energy effectively at every collision. Diffusion is much less, so that they follow the electric field lines more closely.

MECHANISM OF CONDUCTION

The ionic mobility $\mu$ relates drift velocity v to electric field X, by $V=\mu X$. Electron mobility is high, and a drift velocity of $10^6$ cm/s or greater may be obtained. Electronic mobility is not a true constant, but varies with the electric field, pressure, temperature, and gas composition. Although dependent on these quantities to some extent, the mobility of heavy ions is much more constant. Drift velocities are usually of the order of $10^3$–$10^4$ cm/s. Thus, in a typical conduction device, an electron may move from one electrode to the other before a heavy ion is displaced appreciably.

Even if accurate information about the important processes existed, a precise prediction of the characteristics of the conduction process could not be made. In practice, the theory yields only qualitative predictions. Accordingly, most of the information concerning the various forms of gaseous conduction is empirical.

FIG. 1 shows a sample voltage-current characteristic for a two-electrode lamp device with constant pressure. It is assumed that there is a constant source of ionization which could be any of the primary sources mentioned above.

REGION A, THE COLLECTION OF CHARGES

The current first rises and then over a limited range is relatively constant as the voltage across the electrodes is increased. The initial rise is the result of the collection of charges which were either recombining or diffusing to the walls. The nearly constant current region is the result of the collection of almost all of the charges.

REGION B, THE TOWNSEND DISCHARGE

In this region, further increase in voltage produces an increase in current. Here, ionization by electron impact is occurring. The situation is described by specifying that each free electron makes additional ion pairs in traveling 1 cm in the direction of the field. The number n of ion pairs produced per second in 1 cm at a distance x from the cathode (assuming parallel plate electrodes) is given by the relationship, $n=n_0e^x$, where $n_0$ is a constant depending on the initial number of electrons. This is a form of the Townsend equation, and is the first Townsend coefficient.

In the region B, the increase in current represents an increase in $\alpha$. Near the end of this region, the current i increases as a function of applied field. Here, additional effects are taking place, such as the photoelectric process and secondary emission. This is described by the following equation, where $\beta$ is the second Townsend coefficient, $i_0$ is the initial electron current at the cathode and is the anode current as a function of plate separation x; $\beta$ is also a function of electric field.

$$i = i_0 \frac{(\alpha - \beta)e^{(\alpha-\beta)x}}{\alpha - \beta e^{(\alpha-\beta)x}}$$

At the end of the region, the slope becomes infinite, and if the external resistance is not too large, the current will jump in a discontinuous fashion. The transition is referred to as a spark, and the potential at which it occurs is the breakdown or sparking potential. The region B is called a Townsend discharge and is not self-sustained. Thus, if the source of primary ionization is removed, the discharge will cease.

REGION C, THE SELF SUSTAINED GLOW DISCHARGE

In this region, as the potential reaches the sparking potential, a transition occurs to the region C. This is the self-sustained glow discharge region. Over an extensive current range, the voltage drop remains substantially constant. During the current increase, a glow occurs at the cathode, and at the upper end of the range the cathode is completely covered. At this point, a further current increase can be achieved only if the potential drop across the discharge is increased. This portion of the characteristic is known as the abnormal glow. Throughout this portion of the discharge characteristic curve, secondary effects are significant. Particularly vital are the effects of cumulative ionization and secondary emission at the cathode.

REGION D, THE ARC DISCHARGE

A further increase in current leads to another mode of discharge, the arc. This is shown in region D in FIG. 1. Characteristic of this mode is the low cathode potential fall and the very high current densities. Thermionic emission is considered the predominant effect in the production of the large number of electrons at the cathode necessary for the arc. This is consistent with the very high temperatures known to exist at the cathode. Although the arc discharge has very great commercial value, its operation is not very well understood.

LUMINOSITY AND GLOW DISCHARGE CHARACTERISTICS

Glow discharges typically give off light and the region of the discharge appears to glow with considerable intensity. This glow is quite diffused as contrasted to a high pressure arc discharge. The glow discharge commonly occurs under relatively low pressure, generally in the range of 3–30 torr. Typical currents may be on the order of tens or hundreds of milliamperes; the potential drop across the device may be on the order of several hundreds of volts.

The glow discharge occurs when the potential exceeds that of the Townsend region. Thus, the discharge is field-sustained. Alternately, a continued increase in current produces a region referred to as abnormal glow, and beyond this to the arc discharge. The transition from the abnormal glow to the arc discharge is discontinuous and accompanied by a jump in the current flow and a luminous flash.

REGIONS OF DISCHARGE

There are three main regions of interest in the glow discharge: the cathode fall, the positive column, and the anode region. These will be discussed separately, but it is appropriate first to examine some of the general features of the glow discharge as depicted in FIG. 2. The Aston dark space emanates from the cathode and extends a few millimeters. This is followed by a luminous region, also of limited extend, known as the cathode glow. This is succeeded by a longer dark area, designated the Crookes or Hittorf dark space. Following this is the negative glow region which has poorly defined boundaries and it is succeeded by the Faraday dark space. This changes gradually into the positive column which is luminous and with a length determined by the pressure and distance between electrodes. This region may or may not contain striations which may be either stationary or moving. At the end of the positive column is a thin layer of greater luminosity, designated the anode glow. Between this and the anode is the anode dark space.

CATHODE FALL

The conditions at the cathode are vital to discharge. The current in the cathode circuit is primarily due to positive ions. However, sufficient electrons must be produced at the cathode to maintain the discharge. Electron energy increases with movement toward the anode producing excitation and ionization. These electrons appear to be secondary electrons resulting from positive ion bombardment on the cathode surface. The drop in potential which occurs on the cathode depends on the type of gas and the cathode material. Generally, this potential drop is a large fraction of the total potential drop across the discharge. The production of secondary electrons by this means is inefficient, which explains the large drop.

Electrons starting at rest from the cathode must gain energy to produce excitation. This can be accomplished only by motion in the electric field, and hence there is a minimum distance which the electrons must move before they can produce excitation and consequent light. This explains the existence of the Aston dark space. It might be thought that the cathode glow could be explained by this also, but it is not likely that much of the light from this region is caused by secondary electrons. It appears that most of this light results from the positive ions that have struck the cathode and are returning to the ground state as neutral atoms. There are two facts of importance in this regard. First, the electron density is rather low at such a short distance from the cathode. Second, the wavelengths present in the radiation indicate transitions involving states of rather high degrees of excitation. These high energy states probably could not be produced by the electrons from the cathode at that distance.

The Crookes dark space is a region of nearly uniform electric field. Most of the cathode drop occurs in this region and here the positive ions gain most of their energy before striking the cathodes. The electrons from the cathode gain sufficient energy here to produce cumulative ionization near the end of the space. In the negative glow which follows the potential is relatively constant. Electrons from the cathode and from cumulative ionization, lose energy by inelastic collisions and produce a large amount of excitation. The boundary at the anode end of this space is poorly defined because of the broad distribution in electron energy. The deceleration of the electrons at the end of this region results in a negative space charge. Thus the electrons that move into the Faraday dark space gain energy.

POSITIVE COLUMN

The beginning of the positive column is the result of excitation by these electrons, which is a product of the balance between several processes. There is a nearly uniform potential drop which results in ionization throughout the entire region. However, there must be a loss of ions to compensate for this production. This takes place primarily by diffusion to the walls, where some recombination occurs. The electrons, with their greater mobility diffuse to the walls, producing a slight negative potential relative to the center of the discharge. This negative potential limits further electron diffusion and produces positive ion diffusion outward. This process is known as ambipolar diffusion. The positive column is not essential in maintaining the discharge. If the distance between electrodes is changed, and the pressure and current is constant, the extent of the positive column and the potential across the discharge change accordingly. The features of the anode and cathode regions will remain unaltered by the change in electrode potential, until the positive column no longer exists.

A feature of this region is a succession of alternately luminous and dark regions, called striations, which may be stationary or moving and usually occur when the discharge is operated at relatively high pressure. Their presence is related to the fact that in general the atomic species in the discharge are de-excited in times that are short compared to those required for them to diffuse through the positive column. Pure, inert gases do not show the effect, probably because they are excited into metastable, long-lived states. Under some conditions, the Penning gas mixtures used in glow discharge, fluorescent tubes can exhibit this effect, and it is related to the frequency of the electrical drive signal, used to excite the tube.

ANODE REGION

At the anode end of the positive column, the positive ions are repelled. This produces an increase in electric field, which causes the electrons to gain energy and excite more effectively. Thus the positive column ends in a region of increased luminosity called the anode glow.

OTHER CHARACTERISTICS

There are many other aspects of the glow discharge that are important. One such phenomenon is cathode sputtering. Here the positive ions that are accelerated into the cathode knock out atoms or groups of atoms from the surface. Another is abnormal glow, where the voltage across the discharge remains nearly constant while the current is increased in the normal glow mode. This current increase is accompanied by an increase in the area of the cathode glow. When the glow has completely covered the cathode, a further current increase results in an increase in the cathode potential drop, and hence the potential drop across the discharge. This is the abnormal glow, which is characterized by more intense light emission and increased sputtering.

SPUTTERING

Sputtering refers to atoms or groups of atoms which are ejected from a metal surface as the result of heavy-ion impact. It generally takes place at the cathode of a self-maintained gaseous discharge, indicating that the important agent is the positive ion. Although sputtering is useful for certain processes, such as the generation of a clean surface, it is usually harmful. In the case of an oxide-coated, thermionic cathode, sputtering by positive-ion bombardment may destroy the surface completely. This phenomenon may not detrimentally affect the bulk cathode structures of a cold cathode lamp, inasmuch as those cathodes are designed to be heated by ionic impact, and they are usually devoid of oxide coatings. The electrons in a cold-cathode tube are produced by bombardment of the cathode by ions and/or by the action of a localized high electric field. The voltage drop across such a tube is higher than in the hot-cathode tube because of the mode of electron generation and because current flow is limited. FIG. 3 shows the effect of tube geometry and gas pressure on the voltage required to initiate a cold-cathode discharge.

The threshold energy for sputtering is dependent on surface material and the bombarding ion. It has been found empirically that the mass m sputtered per unit time is given by the equation:

$$m=k\,(V_C c-V_0)$$

where k and $V_0$ are constants, and $V_C$ is the potential through which the ion has fallen, and is therefore a measure of the energy of the ion. Further, it has been demonstrated that the sputtered mass decreases as the pressure increases. The sputtering process becomes more efficient as the mass of the ion is increased. The ejected atoms may come off either as neutral particles or as ions.

Although the cause of sputtering is uncertain, local heating is considered a prominent part of the process.

LAMP DIMMING

The key to fluorescent lamp dimming is the characteristic volt/ampere profile of the device. It has been determined that fluorescent lamps exhibit the classic profile of all gas discharge devices, as shown in FIG. 1. FIG. 1 reveals the four primary "regions" outlined above demarcated by changes in effectual physical modes, and six areas of the profile are prevalent that are bounded by changes in the volt/ampere gradients. To the left of the well defined "ionization breakdown peak" is a negative resistance area, (sometimes called an inverse I/V profile). Here the voltage is falling, while the current is rising. All discharges exhibit this characteristic. The very high currents used in this mode must be externally limited through the use of a current source, series resistance or an inductive ballast otherwise the device will be destroyed as a result of severe power dissipation. To the right of the peak are gradients representative of a positive resistance area, where falling voltages are coincident with lower current values, as might be expected by usual impedances that obey Ohm's law. Conventional "bright" lamp operation takes place with an intercept lower on the profile where the current is a hundred or hundreds of milliamperes (mA). This is within the region of "Self-Sustained Glow Discharge". At the minimum of the peak, the profile undergoes a major change in its characteristic. A constant voltage plateau is evident from 100 mA and ends at 1 mA. The voltage is constant while the current is falling by two orders of magnitude. The constant voltage characteristic is followed by a large, unique, negative resistance area. In this area of the profile, the voltage across the device rises quickly by hundreds of volts in an almost linear fashion, but the current falls abruptly over a very large range of four orders of magnitude from about $10^{-3}$ to $10^{-7}$ A.

The region C and the self-sustained glow discharge mode of the profile then ceases. Note that if the operation of a lamp was begun at a current of $3\times10^{-1}$ A and remains conducting at a minuscule current of only $10^{-7}$ A, that amounts to over six orders of magnitude, or a range of over a million to one.

The profile does not end here, but rather another distinctive characteristic is evident and a different constant voltage plateau is found as the region of the "Townsend Discharge" is entered. The boundary of the Townsend discharge is significant because the magnitude of the voltage of this plateau is the highest compliance voltage required in a current source lamp dimming circuit. The value of this plateau is usually between 40% and 60% of the peak ionization voltage needed to strike the lamp. The Townsend discharge region and its constant voltage profile continues as the current is lowered from approximately $10^{-7}$ A to $10^{-10}$ A. Three decades are spanned and the Townsend discharge region ends with the beginning of another change in characteristics. After the cessation of the constant voltage profile, another area of positive resistance behavior is observed. The voltage potential across the device falls rapidly while the current drops from about $10^{-10}$ A to below $10^{-12}$ A. This is the region of the "collection of Charges". There is an almost constant current aspect of the profile, in that the voltage falls rapidly and the current remains nearly constant at just below $10^{-12}$ amperes (1 pico amp). As shown in FIG. 1, this gas conduction volt/ampere profile spans over 14 orders of magnitude from hundreds of amperes on the arc discharge end to less than one pico ampere before current flow ceases.

Although FIG. 1 is not the profile of any particular lamp, it is representative of a gas discharge device. Test data taken on two fluorescent lamps correspond closely to this general profile.

Currently, pulse width modulation (PWM) techniques are commonly used for controlling the range of dimming of such fluorescent lamps. However, this range is comparatively limited. There is no known PWM controller that has demonstrated a dimming ratio greater than 2000:1 or 66 dB. For example, a fluorescent tube used to backlight liquid crystal displays used in aerospace applications require brightness ratios that extend from levels readable in direct sunlight, at the brightest, to very dim levels readable with night vision goggles. Such brightness ratios require fluorescent tube dimming over a range of foot Lamberts from 0.2 ftL to 10,000 ftL,a ratio of 50,000:1 or 94 dB. This range has never been achieved by high frequency pulse width modulation (PWM) techniques currently in common use. The maximum pulse width that could be applied is limited by the period of the driving waveform on the high end, and by the minimum pulse width possible, based on the rise time of the switching transistors, which is a function of their speed. Practical switching devices do not yet possess the sub-nano second response necessary to achieve the required dimming range.

It is therefore an object of the present invention to provide a method and means for controlling current flow in gas discharge tubes.

It is another object of the invention to provide a system for controlling the dimming of fluorescent lamps over a broad brightness range.

It is a particular object of the invention to provide a fluorescent lamp driver system which can achieve luminous output control over a range from about 0.2 ftL to 10,000 ftL, an increase in performance and range of 25 times or an increase of 28 dB over prior practice.

SUMMARY OF THE INVENTION

Analysis of typical I–V characteristics of gas discharge lamps indicates that the lamps will operate over a very broad luminosity range, e.g., about 0.2 ftL to 10,000 ftL, if their currents could be properly controlled. In effect, the limiting factor in achieving such operation is a function of the lamp driver and not the lamp itself. However, the volt/ampere profile of the lamp whose luminous output is to be controlled is of paramount importance. The volt/ampere or I–V profile uniquely defines the electrical characteristics of a lamp, and only voltage potentials and respective current flow values that are defined by the curve are valid. Consequently, if an ionization current of 10 mA is required, the voltage potential that corresponds to that current must be applied across the electrodes of the lamp. It has been discovered and demonstrated that one way to accomplish this is to implement a current source with a high compliance voltage. Tests show that the luminous output of the lamp is a somewhat linear function of the lamp current over a very broad range. Feedback within the current source forces the proper voltage across the lamp regardless of the impedance characteristics that change as the operating current is varied to obtain the desired luminous output. The luminous outputs change smoothly as the lamp current traverses the volt/ampere profile of the lamp, while the lamp voltage changes as a function of the feedback and loop gain within the current source.

In accordance with the invention a driver circuit containing a high voltage analog current source, which can be configured in several ways, is connected to the lamp electrodes. Additionally, two external electrodes generate an electrostatic field laterally on the diameter of the lamp such that the glass envelope of the lamp and the gas within form the dielectric of a capacitor and the external electrodes act as the plates. When the internal lamp electrodes are connected in parallel with the external electrodes and are driven from a current source with a high compliance voltage, a very wide dimming range can be achieved. As a higher and higher current is applied, the compliance voltage rises, and the field intensity of the electrostatic field increases. The gas ion population and its level of excitation increases accordingly and the luminous output becomes brighter. There is also a potential across the internal cathodic electrodes of the lamp and the impedance of the lamp falls, because of increasing ionization. As this process continues, a current will flow between the cathodic electrodes in accordance with the I–V characteristics of the lamp.

The lateral electrostatic fields are used to continuously maintain the gas in the tube in an ionized state so that "starting" or "restarting" is not required, unlike many prior art systems with PWM dimming circuits. The current is preferably supplied by a true analog voltage-to-current converter that has a dynamic range inherently wider than conventional PWM circuits. A modified, transformer coupled, push-pull converter with an analog-current-driven primary circuit is suitable in this application. The lamp driver must be capable of providing a high compliance voltage consistent with the I–V profile of the lamp. A subordinate primary winding on the transformer may be used to generate the energy necessary to support the electrostatic field and to help reduce transformer magnetization current since a low magnetization current is necessary in order to accurately control the sub-milliampere secondary, lamp current. Alternately, the electrostatic field electrodes can be supplied variable and controlled potentials that are generated by a distinct and separate, but related driver circuit.

DETAILED DESCRIPTION OF THE PREFERRED EMBODIMENTS

Figure 1:
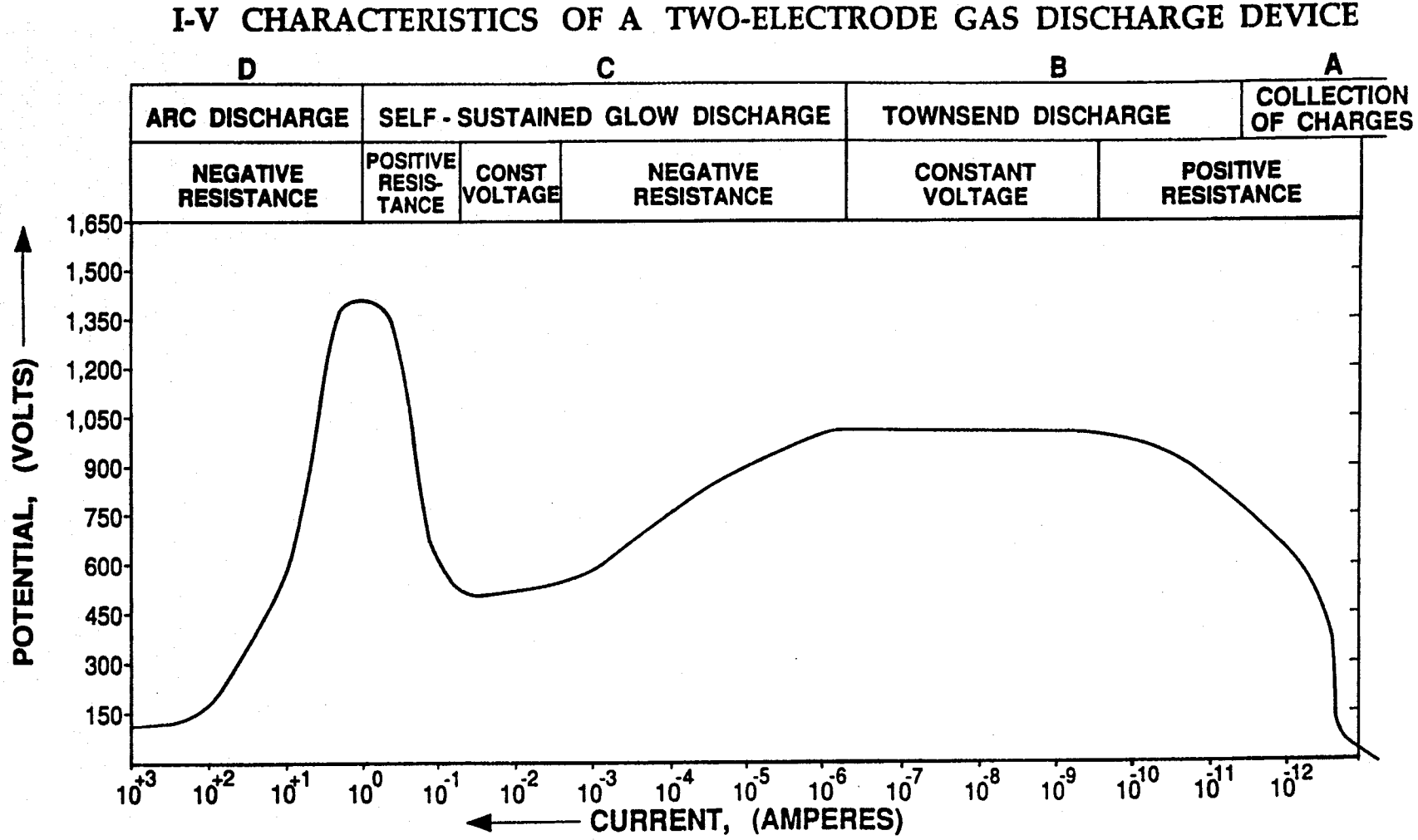
FIG. 1 is a plot illustrating the current-potential characteristics of a two-electrode gas discharge device with constant pressure.
Figure 2:
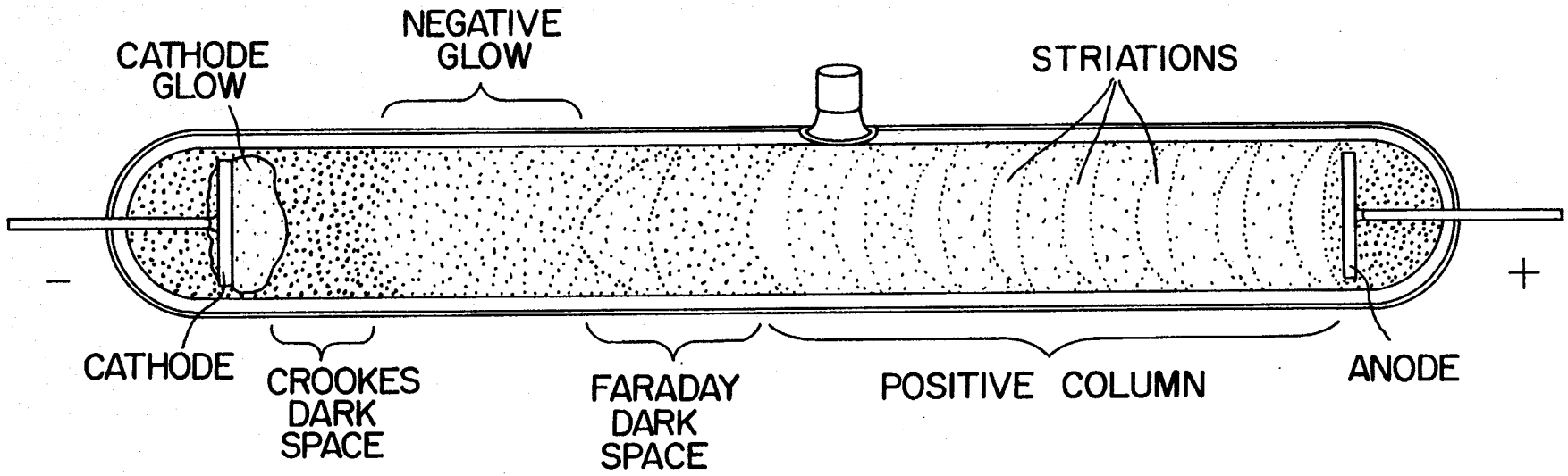
FIG. 2 is a diagram illustrating the general features of a glow discharge in a two-electrode device at approximately 0.1 mm pressure.

The present invention involves a system for operating gas discharge lamps over a wide range of luminosities and particularly a driver arrangement for fluorescent lamps that is capable of varying or dimming their light intensity over a broad range such as from less than 1 ftL to greater than 10,000 ftL. Control of the variation in luminosity is achieved through control of the discharge current flow in the lamp tube. This broad range control is based on the determination that the luminosity output of the lamp is a function of the lamp current over a very broad range, when the lamp is operated in an electrostatic field of sufficient field strength. A lamp driver in the form of a current source with a high compliance voltage can be used to implement the production of the currents required, along with a pre-ionization electrode arrangement outside of the lamp tube to generate the required electrostatic field. Accordingly, a high voltage analog current source may be connected across the internal cathodic electrodes of the lamp to produce a charge flow current between these electrodes from one end of the lamp to the other. The external electrodes produce an electrostatic field within the proximity of the tube causing ionization of the gas therein. The electrode and tube arrangement form a capacitor with the glass envelope of the tube and the internal gas acting as a dielectric and the external electrodes forming the plates. With the external electrodes connected in parallel with the internal lamp electrodes, the current produced by the high voltage source can be controlled over a very wide range and thus the luminosity of the lamp can be regulated or dimmed over such a range. Alternately, the external, electrostatic electrodes can be driven by a distinct and separate circuit, as will be described. Both hot cathode and cold cathode gas tubes can be driven in this manner.

The dimming range for a tubular fluorescent lamp can be extended by a factor of 25 in accordance with the invention through the use of the electrostatic excitation mode. This is accomplished by placing the gaseous fluorescent tube in a high frequency, AC field. Such a field is generated by placing two electrostatic ionization electrodes external to and adjacent the lamp, in one of several feasible physical configurations. Three electrode construction methods that will provide satisfactory operation include:

1. electrode plates that may be optically transparent utilizing ITO conductive film;
2. wire or conductive foil electrodes on opposing diameters of the lamp; and
3. two planar printed circuit traces on a circuit board behind the lamp.

The electronic drive circuits used to excite any of the above electrode configurations can be conveniently configured in various ways by one of skill in the art. A voltage potential of from about 200 volts (peak-to-peak) to about 1800 volts (peak-to-peak) at an operating frequency selected over a range of about 20 KHz to about 100 KHz is typically required. It has been found to be useful and practical to set the operating frequency in accordance with the resonance of a tuned circuit formed by the capacitance of the electrodes and the inductance of the small step-up transformer used in the drive circuit. Typical electrode structures and transformers have in practice resulted in a useful operating frequency of 60 KHz with a 50% duty cycle.

Figure 4:
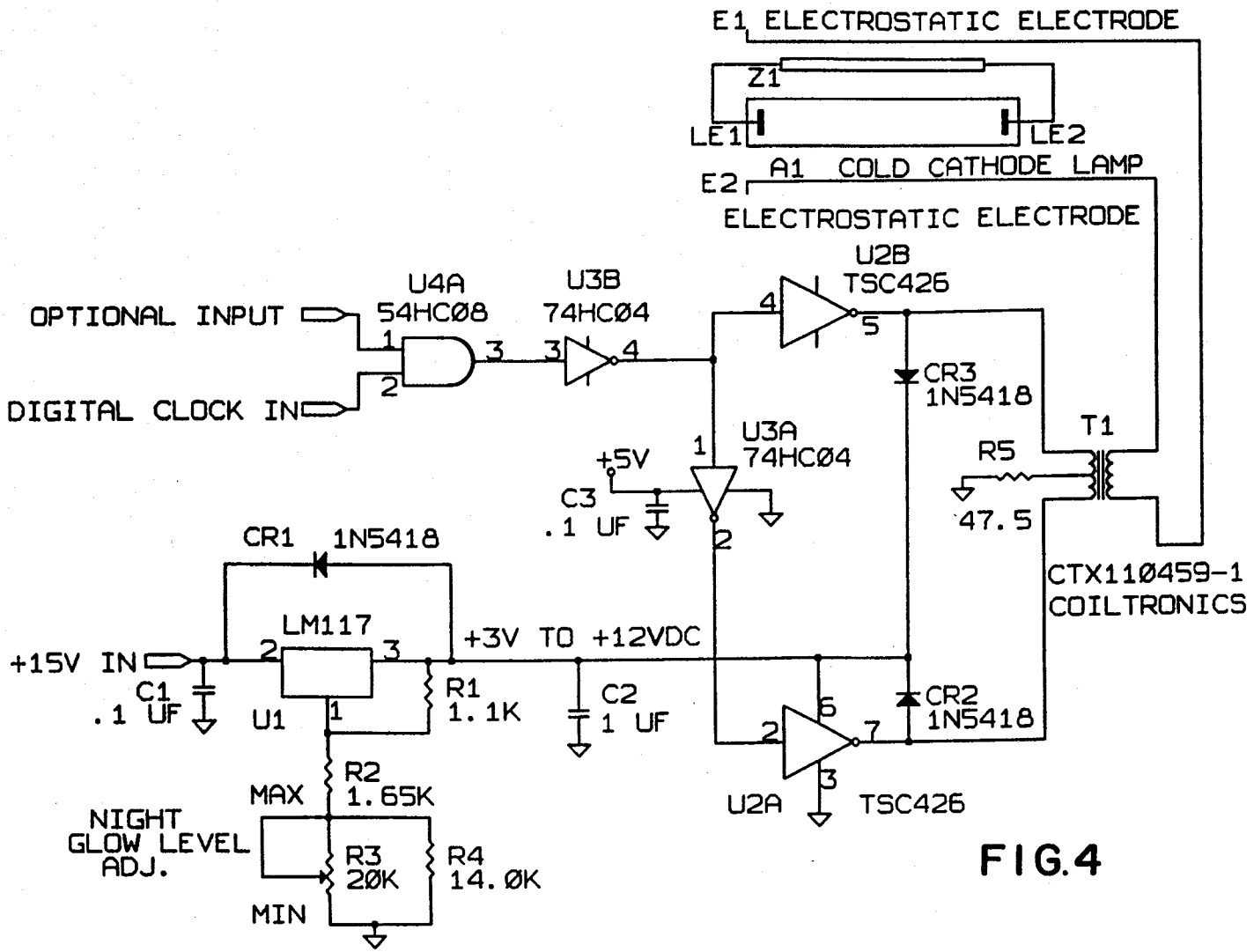
FIG. 4 is a schematic diagram of a circuit that demonstrates the concept of electrostatic drive and which is connected to external electrostatic ionization electrodes in accordance with the invention.

This mode of operation for any fluorescent lamp can easily be demonstrated and carried out by the circuit shown in FIG. 4. A detailed functional description of this circuit is as follows.

A variable voltage regulator, U1, (LM117), connected to a +15 VDC input, is configured to supply a voltage over a range of 3 volts to 12 volts in accordance with the setting of a ten-turn potentiometer, R3. Resistor, R1, sets the bias current level in the adjust leg of the regulator U1, and resistor, R2, sets the 3 volts minimum level at the minimum control setting. The resistor, R4, sets the 12 volts output level of the regulator when the "NIGHT GLOW LEVEL" control, R3, is adjusted to its maximum setting.

Capacitors C1 and C2 bypass the input voltage and the output voltage of the regulator U1, respectively. The diode, CR1, protects the regular integrated circuit upon abnormal discharge of C2 during the power down interval.

The variable output voltage present at the output, pin 3, of the regulator U1 is delivered to the power supply input pin of a TSC426 driver chip, U2 (U2A and U2B). This arrangement causes the magnitude of the output levels of chips U2A and U2B to vary over a range of from about 2 volts minimum, to 10 volts, maximum.

A digital clock signal of a specific frequency, with a 50% duty cycle is input through a 54HC08 chip U4A to U3B, of a 74HC04 digital invertor chip. The digital output of this device is delivered to the input of both the driver chip, U2B, and digital invertor chip U3A. The output of U3A is delivered to the input of driver chip U2A.

This arrangement applies complimentary inputs to the driver chips U2A and U2B. The capacitor, C3, provides power bypass action for invertor chip, U3. The outputs of the two drivers U2A and U2B are applied to both ends of a center-tapped step-up transformer, T1 (COILTRONICS P/N CTX110459-1). The center-tap of this transformer is grounded through a 47.5 ohm resistor, R5, which limits the primary current. Diodes CR2 and CR3 protect the driver chip, U2, against inductive spikes from the primary of the transformer, T1. This results in a push-pull driver for a voltage step-up converter.

This circuit configuration provides an output voltage range of from 200 volts (peak-to-peak) minimum to 1800 volts, (peak-to-peak) maximum, which is supplied to the "electrostatic ionization electrodes", E1 and E2, that are external to, but adjacent to the cold cathode tubular fluorescent lamp, A1. This electrode voltage is made to vary through adjustment of the control potentiometer R3. The varying output level of the voltage regulator U1 imposes more or less voltage across each half of the primary winding of transformer T1 on alternate halves of the digital input cycle.

In practice, the frequency of the digital clock input is selected to correspond to the resonance of the electrode (E1, E2) and transformer (T1) combination. In testing that has been conducted, this frequency typically was found to be 60 KHz. One way to accomplish this selection process is to set potentiometer R3 at midscale or below and vary the clock frequency until the secondary voltage of transformer T1 is at a maximum value.

It should be noted that in this electrostatic mode of operation, no power is delivered to the internal cathodes LE1, LE2, of lamp A1 in the conventional fashion, and this electrostatic drive process can be demonstrated with the internal lamp cathode left floating.

However, it will be found that if a passive impedance Z1 is connected across the cathodes LE1, LE2, of the lamp A1, the low level luminous uniformity will be improved, and the ratio of the luminous output level relative to the applied electrostatic voltage will increase. This impedance provides a return path for current and allows a very small induced current to flow through the gas which equalizes the ionization and electric fields of the tube.

In some applications this impedance will be provided by the "day level" driver circuits of the lamp when the electrostatic drive techniques are used in conjunction with circuits used to provide the power to the internal cathodes of the lamp during day level operation.

Figure 5:
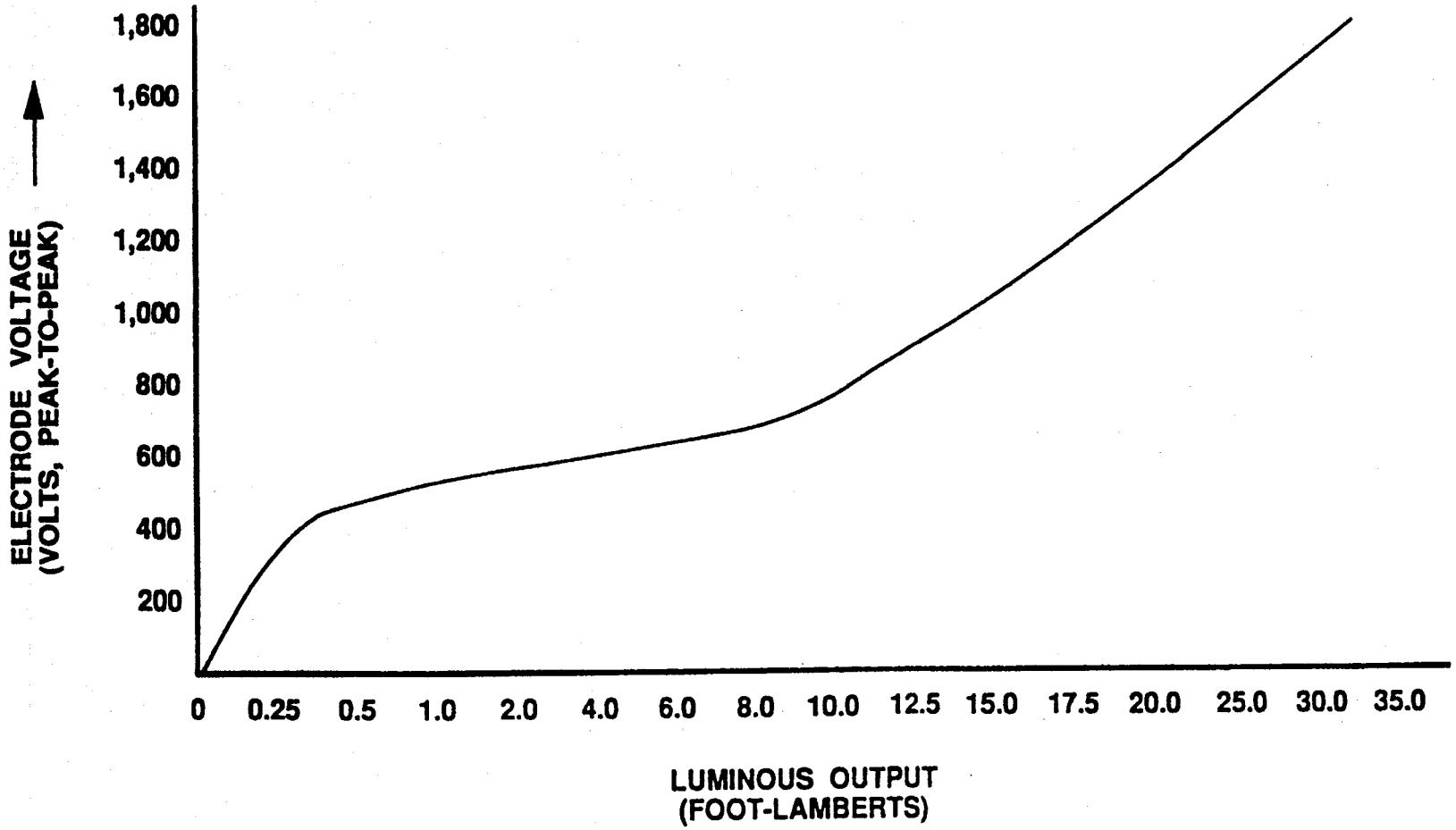
FIG. 5 is a plot of the relationship between the electrostatic ionization electrode voltage and the luminous output of a gas tube in accordance with the invention.

The present electrostatic glow mode driver principles described here can be used in conjunction with any number of florescent lamp driver circuits, including, as will be shown, current mode drivers or PWM circuits previously limited in range to only 2000:1. With the invention the lower range of luminous output will be extended over a range of from 30 ftL to 0.2 ftL. The relationship of the electrostatic electrode voltages relative to the luminous output level is shown in FIG. 5.

IONIZATION ELECTRODES

Figure 3:
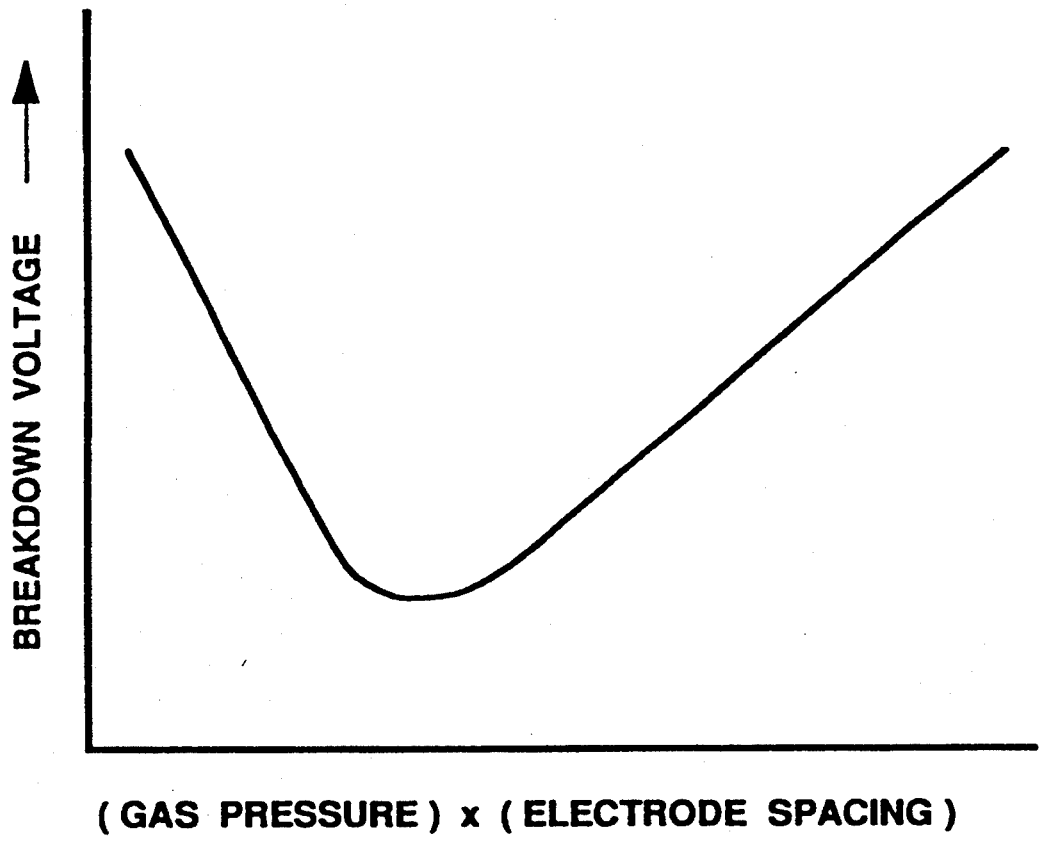
FIG. 3 is a plot illustrating the effect of gas pressure and tube geometry on the gap voltage required to initiate breakdown in a cold-cathode gas tube.

More particularly, the pre-ionization electrodes E1 and E2 in accordance with the present invention operate as follows. A low pressure gas can be ionized by any means that can impart sufficient energy to exceed the first ionization potential of the gas in use. For a Penning gas mixture of argon and mercury, such as used in fluorescent lamps, this energy level is approximately 10 to 16 eV. Thus, an electrostatic field can provide enough energy to create an energetic ion population in the gas to make a fluorescent lamp glow. Presumably, this mechanism is that of field emission, similar to that used in an E.L. lamp. The electrostatic field can be provided by the electrodes E1 and E2 disposed externally of the lamp A1. The electrostatic field is generated laterally on the diameter of the lamp, as opposed to electrode potentials that are applied, end to end, over the lamp's length. The distances are shorter, and ionization and excitation of the gas takes place along the entire length of the lamp, eliminating the need to support a current through the column. The general relationship between the ionization potential and the electrode spacing is shown in FIG. 3. As noted above the glass envelope of the lamp and the gas contained therein form the dielectric of a capacitor created by the electrodes.

Figure 6A:
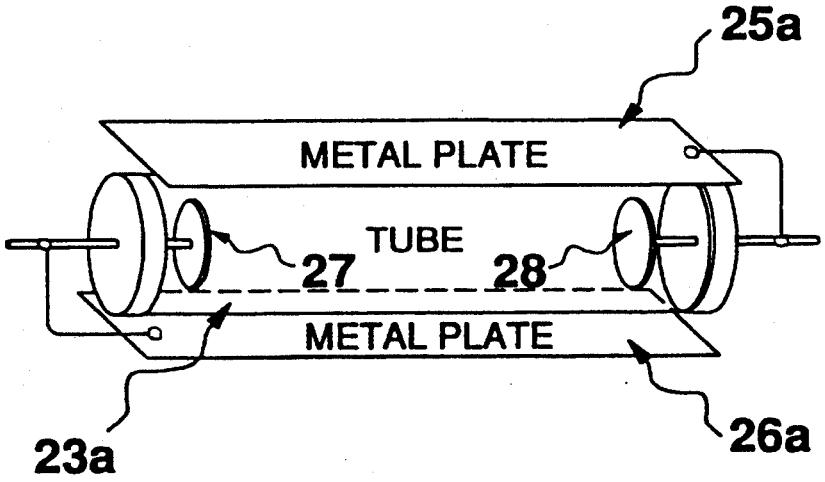
FIGS. 6A, 6B and 6C are diagrammatic views of three alternate embodiments of pre-ionization electrode arrangements in accordance with the invention.

One possible external electrode arrangement is shown in FIG. 6A with the electrodes in the form of metal plates 25*a* and 26*a*. When an AC potential of about 400 volts (peak to peak) minimum to 1800 volts (peak to peak) maximum is applied across the plates, 25*a* and 26*a*, the lamp 23*a* will glow with a very uniform luminous output. This can be accomplished without the cathodic electrodes 27*a* and 28*a* of tile lamp connected to the plates. It is also unnecessary to "strike" the lamp with the usual high-voltage start pulse to generate a luminous output. When the internal lamp electrodes 27*a* and 28*a* are connected in parallel with the metal plates 25*a* and 26*a*, as shown, and the lamp and plates are driven from a current source with a high compliance voltage, a very wide dimming range can be achieved. As a higher and higher current range is commanded, the compliance voltage rises, and the field intensity in the electrostatic field increases. The gas ion population and its level of excitation increases accordingly and the luminous output becomes brighter. There is also a potential across the internal, cathodic electrodes 27*a* and 28*a*, of the lamp 23*a*, and the impedance of the lamp falls, because of increasing ionization. As this process continues, a current will flow between the electrodes 27*a* and 28*a* in accordance with the I–V characteristics of the lamp. Because the gas was pre-ionized, there is no start-up pulse or luminous flash by the lateral electrostatic field. As the current is increased to a greater and greater degree, the impedance of the ionized gas column between the electrodes 27*a* and 28*a* will become lower, and the ratio of the current flowing through the tube, end to end, will be much greater than the displacement current flowing in the electrostatic field of the metal plates 25*a* and 26*a*.

There is a cross-over point between the "electrostatic drive" and the "cathodic electrode drive" and there is a slight jump in the luminous output, at some operational frequencies below 30 KHz. This effect seems to disappear at higher drive frequencies, and is not visible above 40 KHz. The nature of this frequency sensitivity is not yet clear. The magnitude of the increase in the brightness of the lamp at this point in the profile is well below the magnitude of the luminous flash accompanying the striking of a lamp in the conventional way. It is possible to do a "night level start", that is to turn the lamp on and off, at levels of 0.5 fL to 5 fL, without a flash.

Figure 6B:
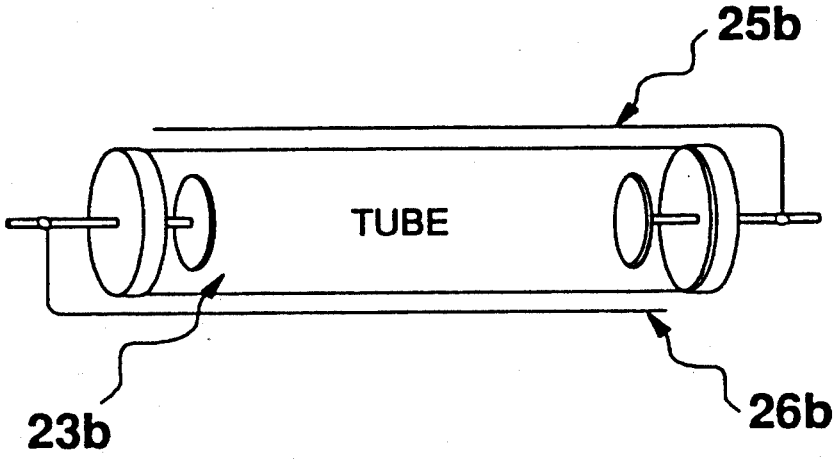

Alternatively, in order to open up the optical path to the lamp, the metal plates 25a and 26a may be replaced by optically transparent plates fabricated using ITO conductive film material, or by thin wire electrodes, e.g. 28 AWG, as shown in FIG. 6B. In addition to the straight two wire, 25b and 26b, and tube 23b configuration shown in FIG. 6B, the lamp geometry may be varied by bending or folding with the electrodes following the contour of the physical body of the lamp placed 180° apart on the diameter of the glass tube. The electrostatic field will produce a very uniform, low level luminous glow over the entire length of all such lamps, regardless of the geometric shape. Luminous output on the bends, or radiuses appear visually to be at the same level as the main body of the lamp. The wire electrodes should be uniformly placed on the glass envelope since the luminous output at very low levels will not be uniform at irregular distances between the lamp and the wire electrodes. Different gas pressures in the lamp do not effect these phenomena.

Figure 6C:
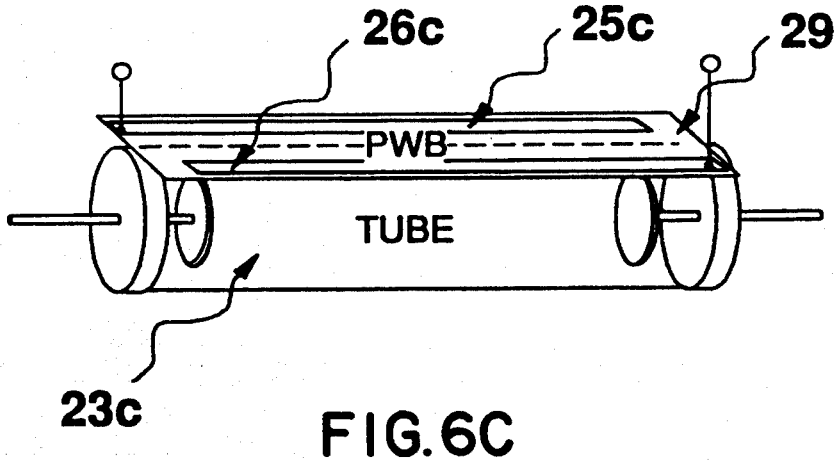

In order to enhance the ease of manufacturing, and to preclude the requirement of a specially designed lamp envelope that would contain the required "ionization electrodes", a preferred electrode configuration has been developed as shown in FIG. 6C. These electrodes 25c and 26c are fabricated by using printed wiring board (PWB) lands 29. In order to facilitate the electrode structure by using PWB lands 29, the printed metal electrodes 25c and 26c must be reconfigured from a position on the diameter, to a planar arrangement, as shown in FIG. 6C, which is depicted in an inverted position for clarity.

The nature of the electrostatic field is altered by this change. However, when the width and spacing of the "printed ionization electrodes" 25c and 26c is properly fixed, the operation is unaltered from that of the metal plate, or wire electrodes. When the electrodes are positioned in one plane, dipole field lobes are created that immerse the gaseous tube 23c. This printed electrode structure performs well when the dimensions of the electrodes are set at a width 0.33 times the diameter of the tube 23c, and are separated at a distance 0.33 times the diameter of the tube 23c. Two lands, 100 mils. wide, and spaced 100 mils. apart were used on 0.289 inch diameter (7 mm) lamp that was 12 inches long and were found to perform well. As will be more fully described below, a subordinate primary winding, such as the four turn winding on T1 in FIG. 7, can be used to supply the energy needed to support the lateral electrostatic field generated by this printed electrode structure, or alternately a separate and distinct driver circuit can be utilized. The resulting arrangement gave very satisfactory dimming characteristics in keeping with the very wide range of luminosities. It has been demonstrated that fluorescent lamps operated at room temperature (25 deg. C) can have their luminous outputs controlled over a range from about 0.2 ftL on the low end, to over 10,000 ftL, at the brightest level, i.e., a dimming ratio of 50,000:1. The lateral electrostatic fields are used to continuously maintain the gas in an ionization state, that does not require "starting" or continuous "restarting", as is sometimes required in pulse width modulated dimming circuits. An analog current source, with a high compliance voltage can be implemented that uses PWM to control only "power-on-demand".

LAMP DRIVER AND DIMMER CIRCUITS

Figure 7A:
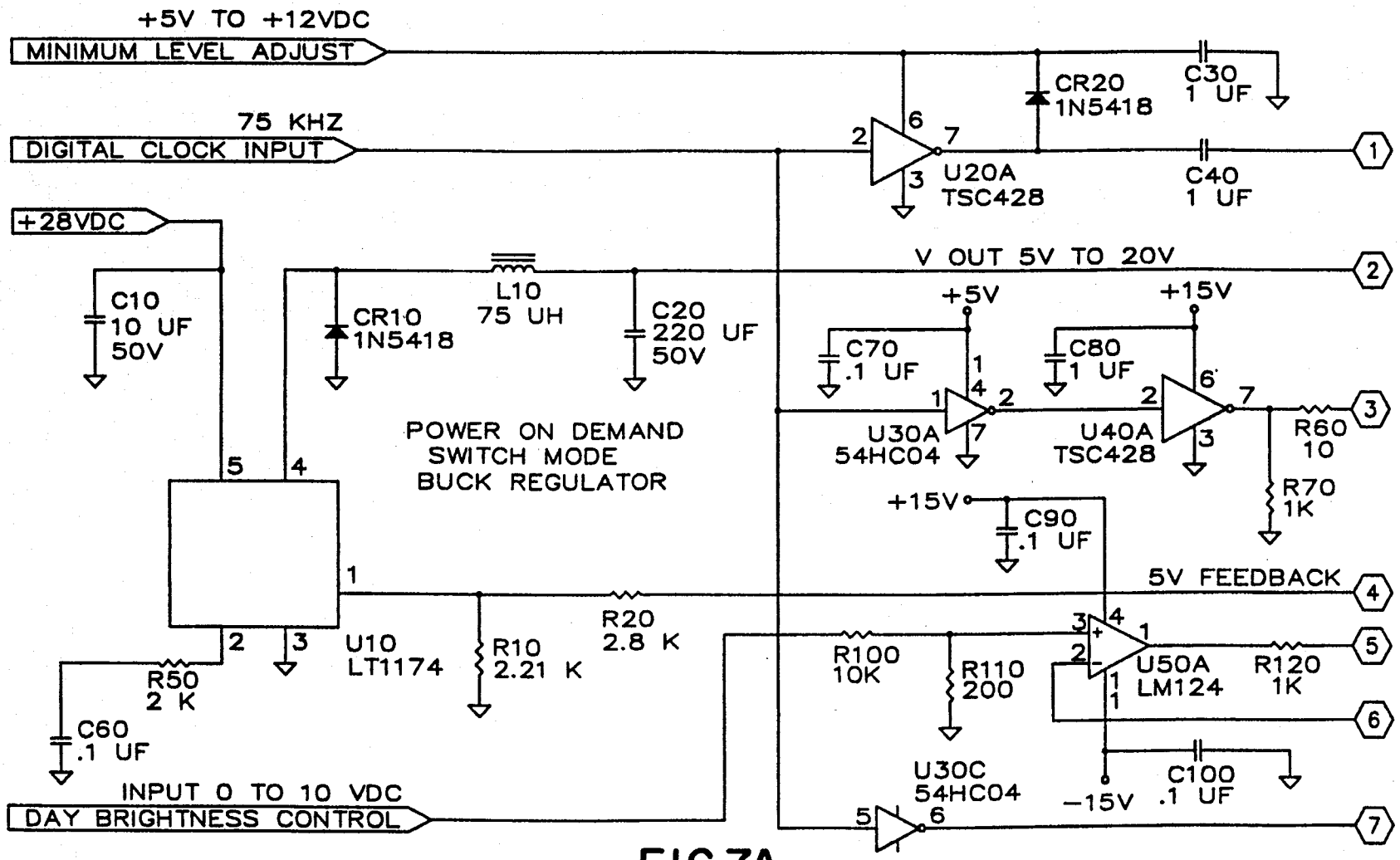
FIGS. 7A and 7B are schematic diagrams of a circuit which is of a compound, parallel configuration, for driving a gas lamp and electrostatic ionization electrodes in accordance with the invention.
Figure 7B:
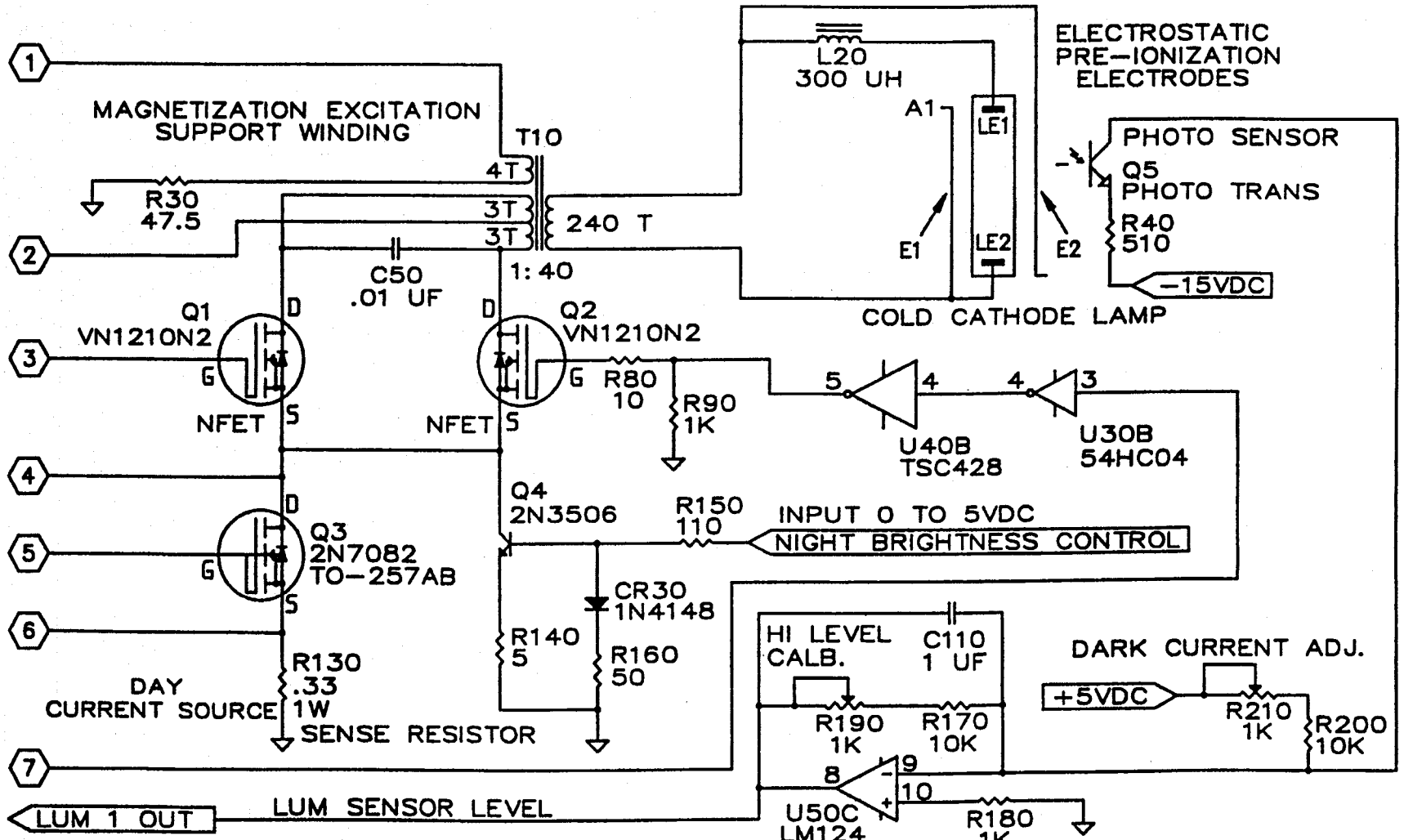

One embodiment of a compound electrostatic and current mode lamp dimmer circuit is shown in FIG. 7, including a switch mode current dimmer for a cold cathode tubular florescent lamp. The description of these circuits is as follows: A switch mode power regulator, U10 (LT1174) is configured to operate as a step-down "BUCK" converter. This chip is supplied with 28 volts DC via pin 5. Capacitor, C10, stores power which can be transferred to the output upon demand. Component L10 is the switch mode inductor and capacitor C20 is the output filter. Diode CR10 is the commutation diode. Resistors R10 and R20 form a voltage divider that sets the feedback level and consequently the output voltage level of the regulator U10. A resistor, RS0, and a capacitor, C6 form a stability compensation network.

The feedback for this power regulator is sensed at the drain of transistor Q3 and the collector of transistor Q4, and the output of the regulator will achieve whatever magnitude that is necessary in order that the voltage level at Q3 and Q4 is maintained at +5 V.

The output voltage of the regulator, U10, is variable from +5 to +20 and is delivered to the center-tap of the primary winding of transformer, T10. The transformer, T10, and transistors, Q1 and Q2, form a high frequency push-pull power converter.

Transistor, Q1, receives a digital gate drive signal from driver chip U40A. Resistor, R6, suppresses spurious responses in the gate circuit of Q1 and resistor R7 aids in the turn-off of Q1. Transistor, Q2, receives a digital gate drive signal from driver chip U40B. Resistor, R80, suppresses spurious responses in the gate circuit of Q2 and resistor R90 aids in the turn-off of Q2. The driver chip U40A receives a digital clock signal with a 50% duty cycle at a frequency of 75 KHz, from the digital invertor chip, U30A. Digital chip, U30B, receives the compliment of the clock supplied to U30A via the inverting action of digital chip, U30C. The output of the digital invertor, U30B, is supplied to the input of driver chip U40B, which drives Q2. This arrangement results in the alternating push-pull conduction of transistors Q1 and Q2 in accordance with the command of the digital clock supplied as an input to this assembly.

During the conduction period of Q1, the voltage supplied to the center-tap of transformer, T10, by the switch mode voltage regulator, U10, is impressed across one half 3 T (3 turns) of the primary winding of transformer T10. During the conduction period of Q2, the same voltage supplied to the center-tap of T10 is impressed across the second half 3 T of the T10 primary winding. The conduction of Q1 and Q2 and the consequential primary voltages across each half of the center-tapped transformer are mutually exclusive.

The current flowing through the primary winding, and that same current through either Q1 and alternately Q2, flows through transistor Q3, during "DAY MODE" or transistor Q4, during "NIGHT MODE". Transistor Q3, in conjunction with operational amplifier, U50A, functions as an analog current source, wherein element R130 acts as the current sense resistor.

Negative feedback is provided by a voltage developed across the sense resistor R130. This voltage is delivered to the inverting input, pin 2, of operational amplifier U50A (LM124). The "Day Brightness Control" voltage is applied to the non-inverting input of amplifier U50A, pin 3, after attenuation by the voltage divider network consisting of R100 and R110. Adjustment of this control voltage, over a range of 0 volts min to 10 volts maximum will cause U50A to provide drive to Q3, and Q3 to sink current in a controlled and limited fashion wherein the control loop and feedback force the voltage drop across R130, the sense resistor, to comply with the attenuated control voltage input on U50A, pin 3.

This action results in a controlled DC current flow through R130, Q3, Q1, Q2 and the AC current flow through the primary winding of transformer T10. This is the "Day Current Source" with a scale factor of 300 milliamperes of primary current per control volt.

Capacitor C50, connected between Q1 and Q2, will provide control of overshoot in the primary voltage swings or it can be selected to resonate with the primary inductance of transformer T10. The first arrangement provides for square wave drive which will deliver more RMS power to the lamp A1 at a given frequency, whereas the latter will provide for sinusoidal drive to the lamp with better EMI performance.

The Day Current Source has a small scale factor allowing the control of high lamp currents for very bright levels of illumination. A second current with more sensitive scale factor is provided using Q4 and its associated components that are arranged in a parallel branch with Q3 and associated components.

The Night Level current control voltage is input through resistor R150 and imposes a voltage drop across diode CR30 and resistor R160. The voltage across this branch is also impressed across the parallel branch of base-emitter Q4, VBE4, and the emitter resistor R140. The VBE drop and the CR30 diode drop are very nearly equal. The voltage across R160 is then equal to the voltage across R140. As the control voltage is adjusted, the voltage across R160, and consequently across R140, changes. This results in the alteration of the current flow through the emitter resistor R140 and the emitter of transistor Q4 in a controlled and limited fashion. As the emitter current in transistor Q4 is varied, the collector current very nearly varies accordingly. The control of current flow in the collector of Q4 varies the DC current flow through transistors Q1 and Q2 and the AC current flow through the primary winding of transformer T10.

Since the value of the emitter resistor R140 is very much larger than that of the "DAYMODE" current sense resistor R130, i.e., 5 ohms to 0.33 ohms, much better control of smaller currents is possible which is necessary for very dim illumination of the lamp during NIGHT operation.

Control of the current in the primary winding of T10 by either the DAY Current Source, Q3 and associated components, or the NIGHT Current Source, Q4 and associated components, will provide for the control of the current in the primary winding of T10, and results in control and modification of the current in the secondary winding 240 T (240 turns) of T10, and the current flow through the florescent lamp, A1.

The switch mode voltage regulator, U10, adjusts the voltage to a level that allows just enough standing voltage across Q3 or Q4 for their proper operation, typically 2 to 5 volts for most transistors that would be used in this application. Most of the power dissipated in this driver is a function of this voltage and the current flowing in R130. The secondary winding 240 T of transformer, T10, supplies the operating current of the lamp through a ballast element L20, such that the load presented to the current driver is always a positive impedance. The lamp voltage varies as a consequence of the current feedback, to whatever voltage is needed to maintain the commanded current through the lamp A1. The voltage can range from 100 Volts (peak-to-peak) minimum to a value of 1600 volts (peak-to-peak) maximum.

The voltage developed by T10 and applied across the ballast L20 and the lamp electrodes, LE1 and LE2, is also supplied to the electrostatic glow electrodes E1 and E2 in a compound parallel configuration, as shown in FIG. 7.

Transformer T1 contains a subordinate primary winding, 4 T (4 turns), as mentioned above. This winding is AC coupled through capacitor C40 to driver chip U20A, (7SC426). A "Minimum Level Adjust" control voltage is input to driver U20A via pin 6. Capacitor, C30, provides bypass action for driver U20A, and diode CR2 protects this device from inductive spikes from transformer T10. Resistor R30 limits the current supplied to transformer T10 by driver U20A.

The "Minimum Level Adjust" control voltage is setup, when the "DAY" and "NIGHT" control voltages are set to zero, to a value that causes the lamp A1 to maintain just the desired minimum luminous output. A typical luminous output level so attained is from 0.2 ftL to 0.5 ftL. Any adjustment up in the Day or Night control voltages will result in an increase of lamp illumination from the adjusted minimum value.

Photo transistor, Q5, (BPX38) with its emitter resistor R40 generates a current proportional to the luminous output of the lamp, A1. This current is translated into a "LUM SENSOR LEVEL" voltage by operational amplifier U50C. The potentiometer R21 and R200 resistor are used to offset the "DARK CURRENT" level of phototransistor Q5. The "HIGH LEVEL CALB" control potentiometer R190 and resistor R170 control the scale factor of the luminous level sensor voltage developed by U50C. Resistor R180 provides bias for operational amplifier U50C. Capacitor, C110 provides filtering action of the output sensor voltage. The "LUM SENSOR LEVEL" voltage is used to sense a drop in the luminous output as the fluorescent lamp ages, or the failure of a lamp.

A second embodiment of the invention involves two separate driving means, one of which provides the electrostatic glow drive, and the other of which provides the internal cathodic current drive.

Figure 8A:
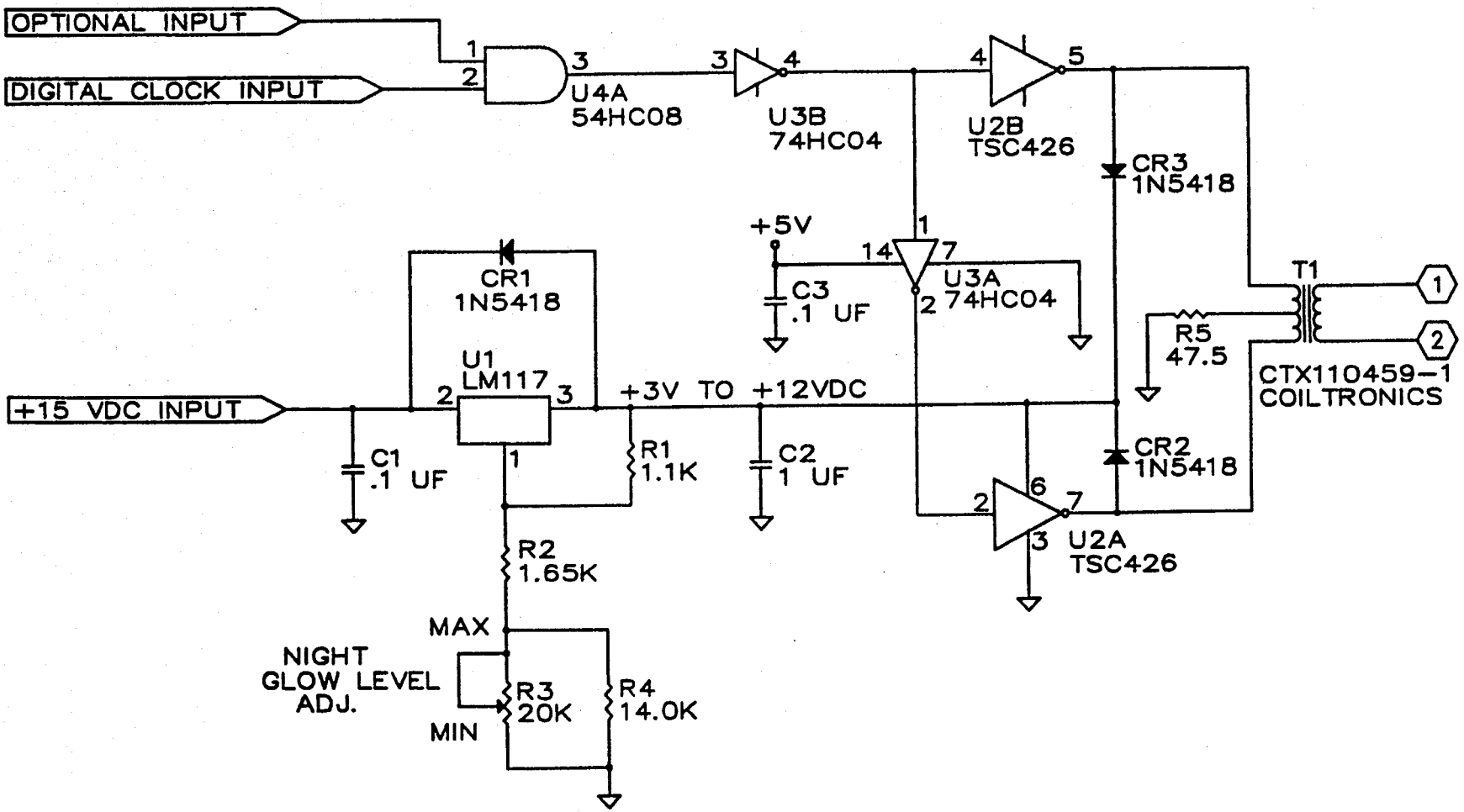
FIGS. 8A–8C are schematic diagrams of a circuit with a dual mode configuration containing separate drive means for the external electrodes and the internal lamp electrodes in accordance with the invention.
Figure 8B:
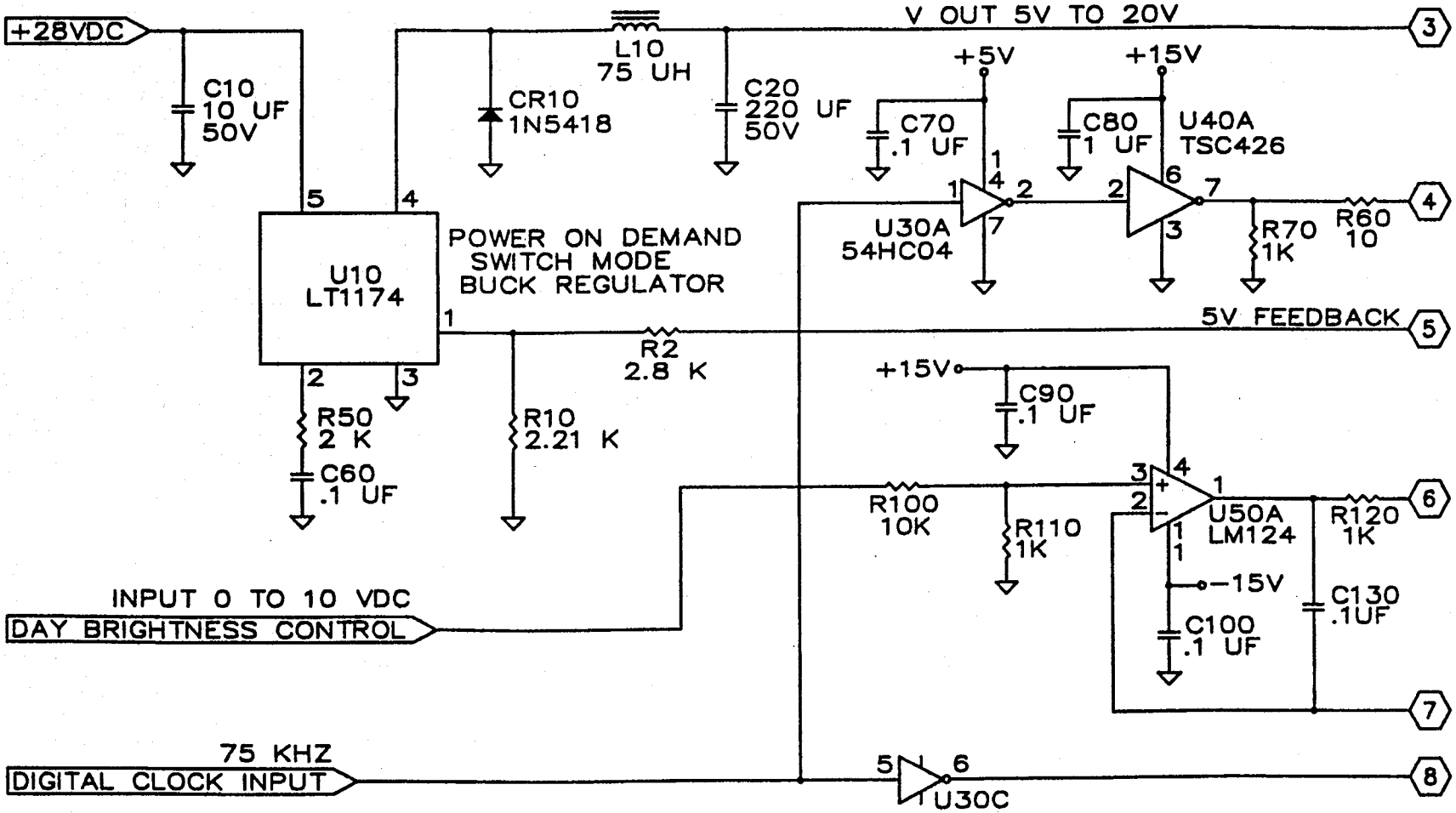
Figure 8C:
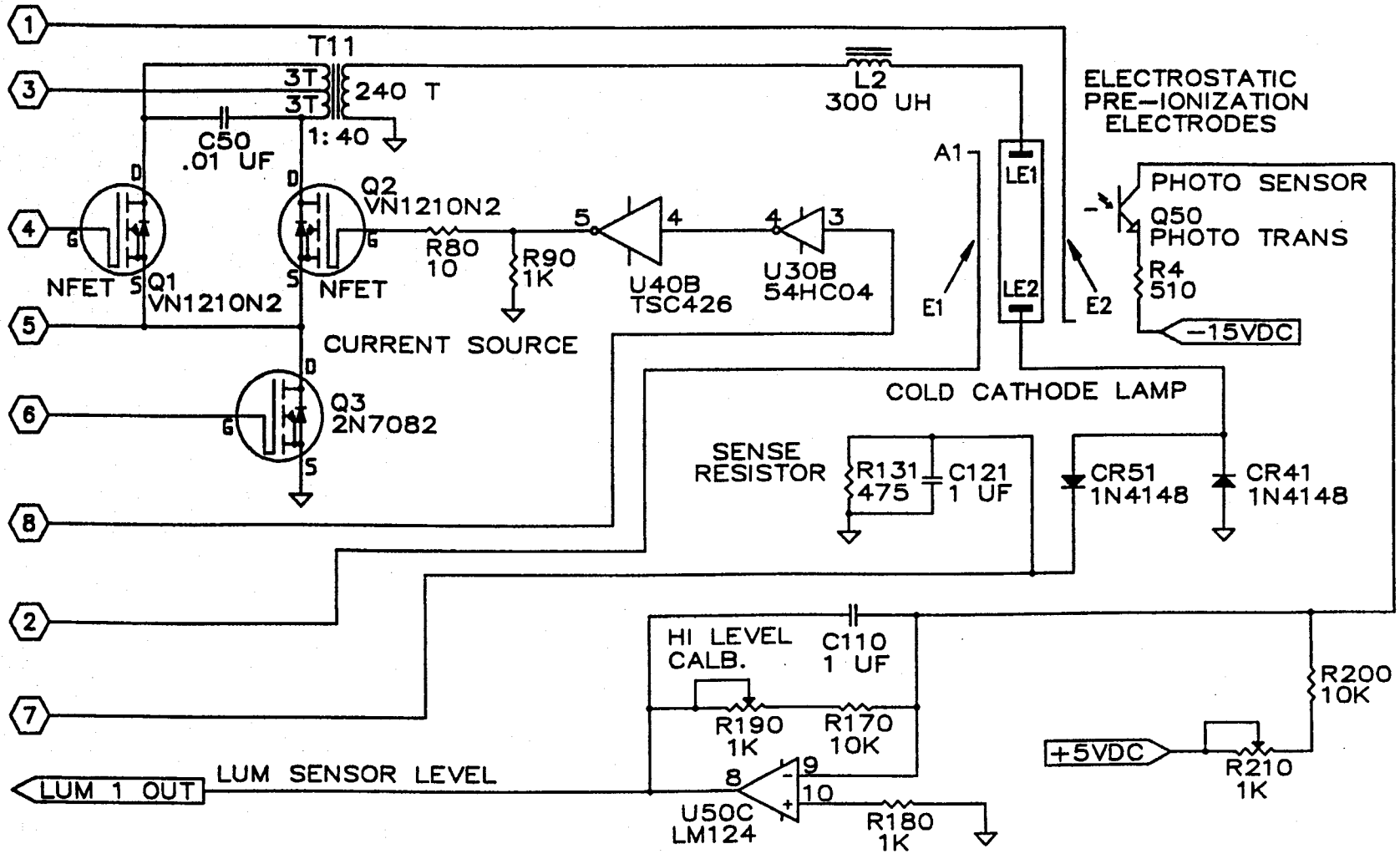

An alternate embodiment of a switch mode current dimmer for a cold, tubular fluorescent lamp is shown in FIG. 8. This circuit is identical to the circuit depicted in FIG. 7, and operates as heretofore described with the following exceptions and alterations.

1. The current source feedback voltage as delivered to U50A, in this embodiment, is developed across a sense resistor R131 that resides on the secondary side of transformer T11. In this arrangement, sense resistor, R13, is operatively coupled to one of the internal electrodes of lamp A1 and senses the lamp current directly. The lamp current is an AC signal with transitions both positive and negative. Therefore, this signal is conditioned by a half-wave rectifier and filter. A diode CR41, (IN4148), conducts only on negative transitions. Diode, CR51, (IN4198) conducts lamp current on the positive swings and this positive current flows through the sense resistor R131. The voltage drop across R131 is proportional to one half of the total current flowing through the lamp, A1. This voltage is filtered by capacitor C121.

2. The subordinate primary winding on transformer T10 has been deleted. Consequently, the driver chip for this winding, U20A and associated components, C30, C40, and CR20 have also been deleted.

3. The electrostatic ionization electrodes, E1, E2, external to, but adjacent to lamp A1, have been electrically disconnected from the internal lamp cathodes, LE1, LE2, and two driving means have now been provided. The current drive for the internal, lamp cathodes is as shown and described with regard to FIG. 7.

4. The electrostatic glow electrodes, E1, E2, are driven by the circuit described and shown in FIG. 4.

In addition to the embodiments already described, there are several arrangements utilizing the ideas, concepts and principles of the invention described herein that can be applied and utilized by those skilled in the art to improve existing systems.

For example, it has been demonstrated that it is possible to extend the dimming range of a Pulse Width Modulation (PWM) lamp controlled through the use and application of the electrostatic ionization (glow mode) drive of the invention, in addition to, and in conjunction with prior art circuits.

Figure 9:
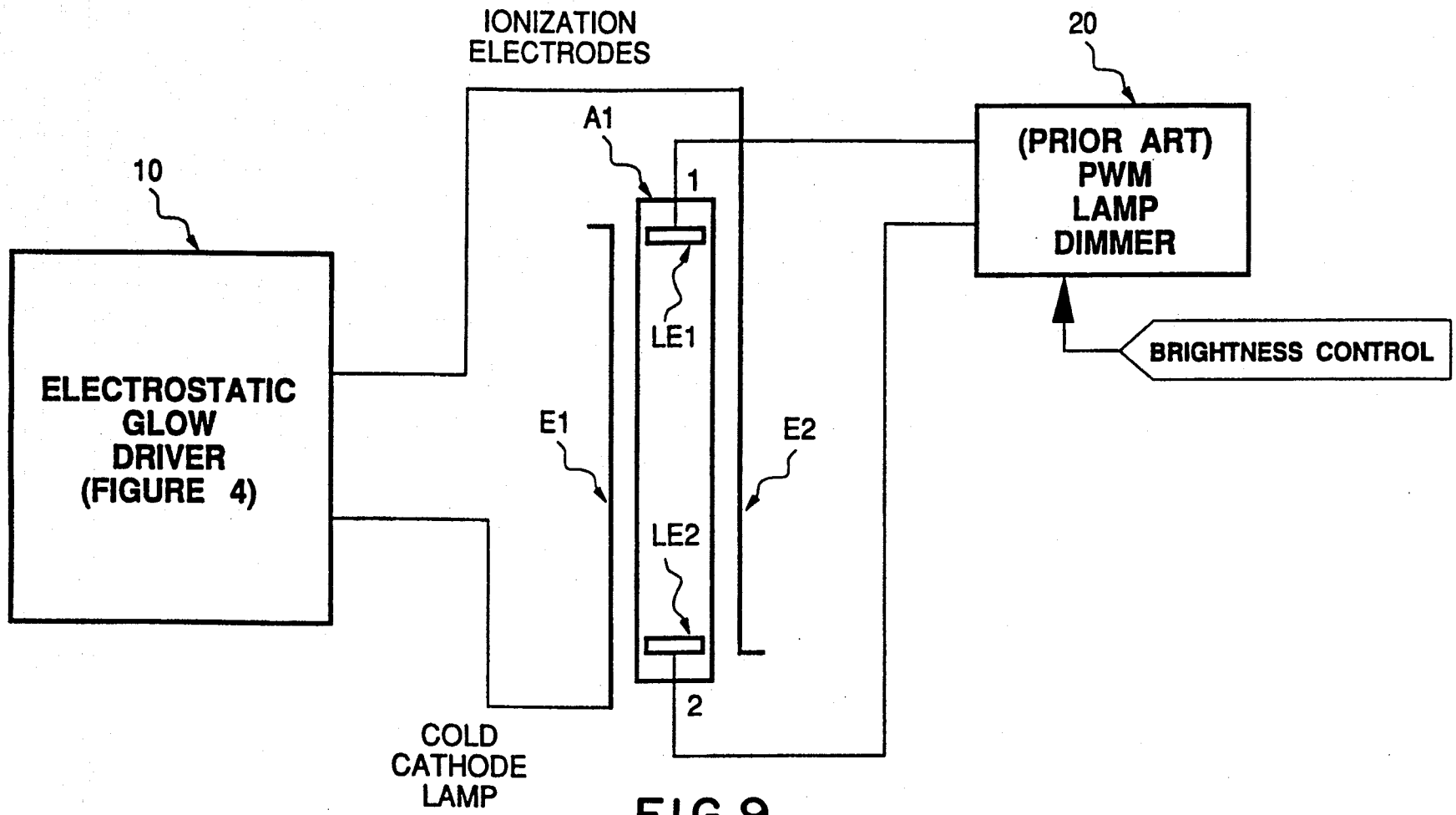
FIG. 9 illustrates one application and utilization of the present invention in conjunction with a prior art PMW dimmer system.
Figure 10:
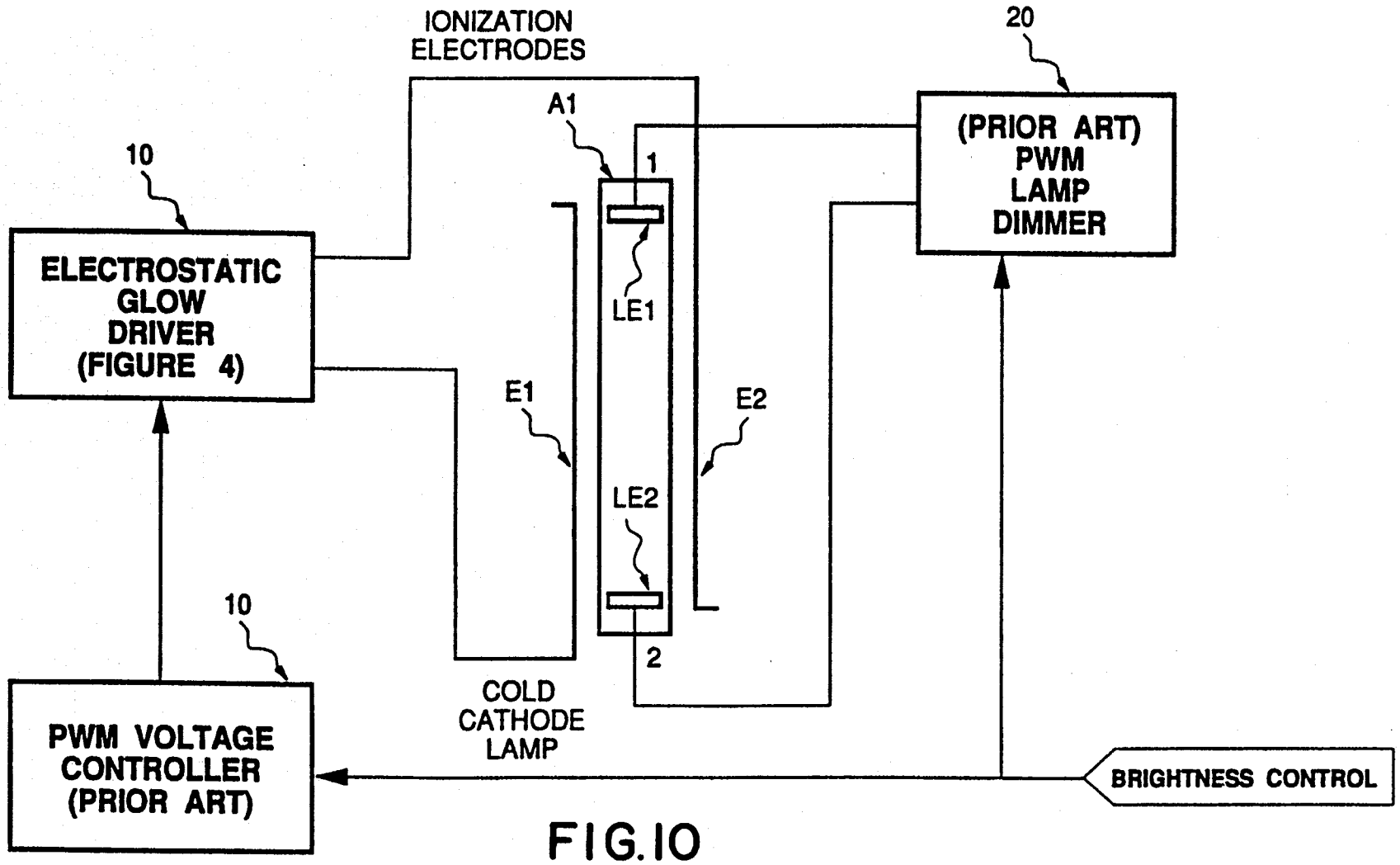
FIG. 10 is another application and utilization of the present invention in conjunction with a prior art PMW dimmer system and voltage controller.

One such configuration is shown in FIG. 9, wherein one of the embodiments of the present invention is added to and combined with a prior art PWM dimming system. The electrostatic glow driver component 10 contains the circuits described in FIG. 4 of the present invention that are used to drive ionization electrodes, E1, E2 external to, but adjacent, the fluorescent lamp A1. A conventional prior art PWM driver 20 is used to drive the internal cathodic lamp electrodes LE1, LE2. This arrangement has been demonstrated to improve the dimming ratio range from 2000:1, achievable with the prior art techniques, to well over 47000:1 using a combination embodying the concepts presented in the present invention. This is an increase in performance of 23 times the previously attainable dimming range. It has also been demonstrated that it is possible to control the generation of the electrostatic ionization fields through the application of PWM techniques to the control of the circuits shown in FIG. 4 of the present invention. Such an arrangement is briefly shown in FIG. 10, wherein a PWM voltage controller 30 is operatively coupled between the BRIGHTNESS CONTROL and the electrostatic glow driver 10.

In summary, then, it will be seen that the luminous output of a fluorescent lamp can be controlled over a very wide dimming range through the control of the lamp current, while the lamp is immersed in a lateral electrostatic field. In accordance with the invention, the current should be supplied by a true analog voltage-to-current converter, that has a dynamic range, inherently wider than conventional PWM circuits. A modified, transformer coupled, push-pull converter with an analog-current-driven primary circuit will meet this requirement. Additionally, the lamp driver must be capable of providing a high compliance voltage consistent with the I–V profile of the lamp. A subordinate primary winding on the transformer may bemused to reduce magnetization current and supply sufficient energy to support the lateral electrostatic field that is generated by pre-ionization electrodes which may be printed on a PWB mounted behind the lamp. It has been demonstrated and shown that external electrodes of various physical makeup and structures can also be driven by separate circuits utilized in conjunction with the main drive.

What is claimed is:

1. Apparatus for driving a gas discharge tube over a wide range of luminous intensity, said discharge tube having a set of internal discharge electrodes at its opposite ends, said apparatus comprising:

ionization electrode means, comprising two electrodes disposed externally along the length of said tube for producing an electrostatic field within the proximity of and transversely over the length of said tube to ionize the gas therein causing the tube to glow with a luminous intensity;

means for driving said ionization electrode means with a high voltage having an adjustable range to produce an ionized gas in said tube between said discharge electrodes; and means for regulating said driving means to vary the amount of ionization of said gas in said tube over said adjustable range whereby the luminous intensity of said tube may be controlled.

2. Apparatus as in claim 1, wherein said two electrodes comprise printed metal lines on a printed wiring board and disposed in parallel with the direction of current flow between said discharge electrodes in said tube.

3. Apparatus as in claim 2, wherein said printed metal lines have a width approximately 0.33 times the diameter of said tube and a spacing approximately 0.33 times the diameter of said tube.

4. Apparatus as in claim 1, further comprising means for driving said discharge electrodes with a high voltage having a wide dynamic range to produce a current flow between said discharge electrodes, and means for regulating said discharge electrode driving means to vary said current flow over a wide range whereby the luminous intensity of said tube may be controlled.

5. Apparatus as in claim 1, further comprising a passive impedance connected across said internal discharge electrodes.

6. Apparatus for driving a gas discharge tube over a wide range of luminous intensity, said discharge tube having a set of internal discharge electrodes at its opposite ends, said apparatus comprising:

ionization electrode means disposed externally of said tube for producing an electrostatic field within the proximity of said tube to ionize the gas therein causing the tube to glow with a luminous intensity;

means for driving said ionization electrode means with a high voltage having an adjustable range to produce an ionized gas in said tube between said discharge electrodes, said driving means comprising an analog voltage-to-current converter having a wide dynamic range producing a voltage ranging from about 200 volts (peak-to-peak) to about 1800 volts (peak-to-peak) at a frequency ranging from about 20 KHz to about 100 KHz; and means for regulating said driving means to vary the amount of ionization of said gas in said tube over said adjustable range whereby the luminous intensity of said tube may be controlled.

7. Apparatus for driving a gas discharge tube over a wide range of luminous intensity, said discharge tube having a set of internal discharge electrodes at its opposite ends, said apparatus comprising:

ionization electrode means disposed externally of said tube for producing an electrostatic field within the proximity of said tube to ionize the gas therein causing the tube to glow with a luminous intensity;

means for driving said ionization electrode means with a high voltage having an adjustable range to produce an ionized gas in said tube between said discharge electrodes, said driving means comprising a transformer coupled, push-pull converter with an analog-current-driven primary circuit; and means for regulating said driving means to vary the amount of ionization of said gas in said tube over said adjustable range whereby the luminous intensity of said tube may be controlled.

8. Apparatus as in claim 7, wherein said primary circuit comprises a subordinate winding means for reducing magnetization current.

9. Apparatus as in claim 3, wherein said primary circuit comprises a subordinate winding means for supplying sufficient energy for supporting the lateral electrostatic field that is generated by the external ionization electrodes.

10. Apparatus for driving a gas discharge tube over a wide range of luminous intensity, said discharge tube having a set of internal discharge electrodes at its opposite ends, said apparatus comprising:

ionization electrode means disposed externally of said tube for producing an electrostatic field within the proximity of said tube to ionize the gas therein causing the tube to glow with a luminous intensity;

means for driving said ionization electrode means with a high voltage having an adjustable range to produce an ionized gas in said tube between said discharge electrodes, said internal discharge electrodes being connected to said driving means in parallel with said ionization electrode means; and means for regulating said driving means to vary the amount of ionization of said gas in said tube over said adjustable range whereby the luminous intensity of said tube may be controlled.

11. Apparatus as in claim 10, wherein said tube comprises a lamp having an I–V profile and said driving means comprises means for producing a high compliance voltage between said discharge electrodes consistent with said I–V profile.

12. Apparatus for producing fluorescent light over a broad range of luminous intensities comprising:

a fluorescent lamp tube containing a fluorescent gas;

first electrode means, comprising first and second electrodes disposed within said tube respectively at its opposite ends, for producing a current flow between said ends;

second electrode means, comprising two electrodes disposed externally along the length of said tube, for producing an electrostatic field within the proximity of and transversely over the length of said tube to ionize said gas;

means for driving said first electrode means with a high voltage to produce a current in said ionized gas between the opposite ends of said tube; and means for regulating said driving means to vary said current over a broad range and thus control the luminous intensity of said lamp tube over a broad range.

13. Apparatus as in claim 12, wherein said lamp tube and gas has an I–V profile and said driving means comprises means driving said first electrode means for producing a high compliance voltage between the opposite ends of said lamp tube consistent with said I–V profile.

14. Apparatus as in claim 12, wherein said two electrodes comprise printed conductive lines disposed side by side on a printed wiring board and in parallel with the direction of current flow between said discharge electrodes in said tube.

15. Apparatus as in claim 14, wherein said printed lines have a width approximately 0.33 times the diameter of said lamp tube and a spacing approximately 0.33 times the diameter of said lamp tube.

16. Apparatus as in claim 12, wherein said regulating means varies said current over a range that controls said range of intensities between from about 0.2 ftL to about 10,000 ftL.

17. Apparatus for producing fluorescent light over a broad range of luminous intensities comprising:

a fluorescent lamp tube containing a fluorescent gas;

first electrode means, comprising first and second electrodes disposed within said tube respectively at its opposite ends, for producing a current flow between said ends;

second electrode means, disposed externally of said tube, for producing an electrostatic field within the proximity of said tube to ionize said gas;

means for driving said first electrode means with a high voltage to produce a current in said ionized gas between the opposite ends of said tube, said driving means comprising an analog voltage-to-current converter having a wide dynamic range; and means for regulating said driving means to vary said current over a broad range and thus control the luminous intensity of said lamp tube over a broad range.

18. Apparatus for producing fluorescent light over a broad range of luminous intensities comprising:

a fluorescent lamp tube containing a fluorescent gas;

first electrode means, comprising first and second electrodes disposed within said tube respectively at its opposite ends, for producing a current flow between said ends;

second electrode means, disposed externally of said tube, for producing an electrostatic field within the proximity of said tube to ionize said gas;

means for driving said first electrode means with a high voltage to produce a current in said ionized gas between the opposite ends of said tube, said driving means comprising a high frequency transformer with an analog-current-driven primary circuit; and means for regulating said driving means to vary said current over a broad range and thus control the luminous intensity of said lamp tube over a broad range.

19. Apparatus as in claim 18, wherein said primary circuit comprises subordinate winding means for reducing magnetization current.

20. Apparatus for producing fluorescent light over a broad range of luminous intensities comprising:

a fluorescent lamp tube containing a fluorescent gas;

first electrode means, comprising first and second electrodes disposed within said tube respectively at its opposite ends, for producing a current flow between said ends;

second electrode means, disposed externally of said tube, for producing an electrostatic field within the proximity of said tube to ionize said gas;

means for driving said first electrode means with a high voltage to produce a current in said ionized gas between the opposite ends of said tube, said second electrode means being connected to said driving means in parallel with said first electrode means; and means for regulating said driving means to vary said current over a broad range and thus control the luminous intensity of said lamp tube over a broad range.

21. A method for producing a luminous intensity in a gas discharge tube having a set of internal discharge electrodes at its opposite ends, comprising the steps of:

producing an electrostatic field externally of and within the proximity of said tube and transversely over its length to ionize the gas therein;

driving said electrostatic field with a high voltage having an adjustable range; and regulating said high voltage over said adjustable range whereby the luminous intensity of said tube is varied.

22. A method as in claim 21, further comprising the step of driving said internal discharge electrodes with a high voltage ranging from about 200 volts (peak-to-peak) to about 1800 volts (peak-to-peak) at a frequency ranging from about 20 KHz to about 100 KHz.

23. A method as in claim 21, further comprising the step of driving said electrostatic field with a high voltage ranging from about 200 volts (peak-to-peak) to about 1800 volts (peak-to-peak) at a frequency ranging from about 20 KHz to about 100 KHz.

* * * * *